US007316476B2

(12) United States Patent
Yokoyama

(10) Patent No.: US 7,316,476 B2
(45) Date of Patent: Jan. 8, 2008

(54) IMAGE RECORDING APPARATUS WITH IRRADIATION CONTROL

(75) Inventor: Takeshi Yokoyama, Hachioji (JP)

(73) Assignee: Konica Minolta Holdings, Inc., Tokyo (JP)

( * ) Notice: Subject to any disclaimer, the term of this patent is extended or adjusted under 35 U.S.C. 154(b) by 326 days.

(21) Appl. No.: 11/033,324

(22) Filed: Jan. 12, 2005

(65) Prior Publication Data

US 2005/0168509 A1 Aug. 4, 2005

(30) Foreign Application Priority Data

Feb. 2, 2004 (JP) ..... P 2004-025011
Oct. 4, 2004 (JP) ..... P 2004-291302

(51) Int. Cl.
*B41J 29/393* (2006.01)
*B41J 2/01* (2006.01)

(52) U.S. Cl. ..... 347/102; 347/19

(58) Field of Classification Search ..... 347/102
See application file for complete search history.

(56) References Cited

U.S. PATENT DOCUMENTS 4,033,263 A * 7/1977 Richmond ..... 101/424.1
5,349,905 A * 9/1994 Taylor et al. ..... 101/488
7,140,711 B2 * 11/2006 Nerad et al. ..... 347/19
7,152,970 B2 * 12/2006 Hasebe et al. ..... 347/102
7,178,913 B2 * 2/2007 Kumamoto et al. ..... 347/102
2004/0119772 A1 * 6/2004 Hoshino et al. ..... 347/19
2005/0168555 A1 * 8/2005 Niekawa ..... 347/102

FOREIGN PATENT DOCUMENTS

JP 60-132767 7/1985
JP 2001-310454 11/2001

* cited by examiner

*Primary Examiner*—Matthew Luu
*Assistant Examiner*—Shelby Fidler
(74) *Attorney, Agent, or Firm*—Finnegan, Henderson, Farabow, Garrett & Dunner, L.L.P.

(57) ABSTRACT

An image recording apparatus, having: a recording head which discharges a photo curable ink which is cured by photo irradiation; a plurality of light irradiating devices which irradiate the photo irradiation to the photo curable ink on a recording medium and each of which includes a light source; a detector which detects an illumination intensity of each of the light irradiating devices; a first judgment section which judges whether the illumination intensity of each of the light irradiating devices is less than a first illumination intensity based on a result of detection by the detector or not; and a controller which controls an energy of the photo irradiation for the photo curable ink in accordance with a detected illumination intensity less than the first illumination intensity, when the first judgment section judges one of the light irradiating devices having an illumination intensity less than the first illumination intensity exists.

14 Claims, 13 Drawing Sheets

FIG.6

DATA TABLE

| PRE-RECORDING CONDITION | | | SELECT AND EXECUTE ONE OF RECORDING MODES | | | | | |
|---|---|---|---|---|---|---|---|---|
| | | | NORMAL MODE | | SPEED CONTROLLED MODE | | POWER CONTROLLED MODE | |
| TYPE OF INK | TYPE OF RECORDING MEDIUM | RESOLUTION (dpi) | SCANNING SPEED (mm/sec) | POWER SUPPLY (W) | SCANNING SPEED (mm/sec) | POWER SUPPLY (W) | SCANNING SPEED (mm/sec) | POWER SUPPLY (W) |
| | | | | | | | | |
| CATIONIC POLYMERIZATION INK | RESIN FILM | 1440 | 400 | 20 | 300 | 20 | 400 | 25 |
| CATIONIC POLYMERIZATION INK | RESIN FILM | 720 | 500 | 25 | 400 | 25 | 500 | 30 |
| CATIONIC POLYMERIZATION INK | RESIN FILM | 360 | 600 | 30 | 500 | 30 | 600 | 35 |
| | | | | | | | | |

FIG.7

| | Y1 | Y2 | Y3 |
|---|---|---|---|
| X1 | 85 | 80 | 80 |
| X2 | 80 | 70 | 80 |
| X3 | 70 | 50 | 70 |
| X4 | 80 | 70 | 80 |
| X5 | 90 | 80 | 75 |
| X6 | 85 | 90 | 70 |
| X7 | 80 | 75 | 90 |

IMAGE RECORDING APPARATUS WITH IRRADIATION CONTROL

BACKGROUND OF THE INVENTION

1. Field of the Invention

The present invention relates to an image recording apparatus in which photo curable ink is discharged on a recording medium to record an image on the recording medium.

2. Description of the Related Art

Recently, an ink jet recording method has been applied to various printing fields such as a special printing or the like, that is, a photograph, various printing, marking, color filter and the like, because an image can be produced easily and at low cost compared to the gravure printing method. Particularly, in the ink jet recording method, a combination of an ink jet printer which discharges and controls small dots, an ink with improved a color range, durability, aptitude for discharging ink and the like, a specific paper having dramatically improved ink absorptivity, coloring property of coloring material, surface gloss and the like is successful in obtaining image quality comparable to a silver salt photograph.

The above described ink jet printer can be classified by the types of inks. That is, there are a phase-change ink jet method using an wax ink which is solid at room temperature, a solvent-based ink jet method using an ink containing a quick-drying organic solvent as a main component, a photo curable ink jet method using a photo curable ink which is cured by photo irradiation such as irradiation with ultraviolet rays or the like. Among them, in the photo curable ink jet method, relatively less odor is produced in comparison with the other recording methods, and an image can be recorded even on a recording medium having no quick-drying property and ink absorptivity other than the specific paper, so that much attention has been paid thereto.

Such photo curable ink jet printer is provided with a recording head for discharging ink as small ink droplets onto a recording medium and light sources for radiating light on a carriage, and the carriage is moved over the recording medium with the light sources on to irradiate the ink just placed on the recording medium with light to immediately cure the ink (for example, refer to JP-Tokukai-syo-60-132767A).

In the above described ink jet printer of the photo curable ink jet method, there is a case that the light sources do not radiate light uniformly due to adhesion of ink mist or foreign matter such as dust or the like on the light sources in an image recording operation or the like. In this case, a portion where light with appropriate irradiation energy is not radiated may be generated, thus, failing to record an image of good quality. Especially, when the illumination intensity of a portion of the light source significantly decreases to generate an illumination intensity decreased portion in which the illumination intensity is less than the specified illumination intensity, the ink placed on the portion of the recording medium corresponding to the illumination intensity decreased portion is not irradiated with light having sufficient irradiation energy, thus, the ink may not appropriately be cured at the portion.

SUMMARY OF THE INVENTION

An object of the present invention is to provide an image recording apparatus which is capable of irradiating all ink placed on a recording medium with light having sufficient irradiation energy to obtain an excellent image.

For solving the problems, in accordance with the first aspect of the present invention, the image recording apparatus, comprises:

a recording head which discharges a photo curable ink which is cured by photo irradiation;

a plurality of light irradiating devices which irradiate the photo irradiation to the photo curable ink on a recording medium and each of which includes a light source;

a detector which detects an illumination intensity of each of the light irradiating devices;

a first judgment section which judges whether the illumination intensity of each of the light irradiating devices is less than a first illumination intensity based on a result of detection by the detector or not; and a controller which controls an energy of the photo irradiation for the photo curable ink in accordance with a detected illumination intensity which is less than the first illumination intensity, when the first judgment section judges one of the light irradiating devices having an illumination intensity which is less than the first illumination intensity exists.

In accordance with the second aspect of the present invention, the image recording apparatus, comprises:

a recording head which discharges a photo curable ink which is cured by photo irradiation;

a light irradiating device which irradiates the photo irradiation to the photo curable ink on a recording medium and includes a plurality of light sources;

a detector which detects an illumination intensity of each of the light sources;

a first judgment section which judges whether the illumination intensity of each of the light sources is less than a first illumination intensity based on a result of detection by the detector or not; and a controller which controls an energy of the photo irradiation for the photo curable ink in accordance with a detected illumination intensity which is less than the first illumination intensity, when the first judgment section judges one of the light sources having an illumination intensity which is less than the first illumination intensity exists.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein;

FIG. 6 is a view showing an example of a time table;

FIG. 7 is a view showing an example of a two-dimensional illumination intensity distribution;

DETAILED DESCRIPTION OF THE PREFERRED EMBODIMENTS

Figure 1:
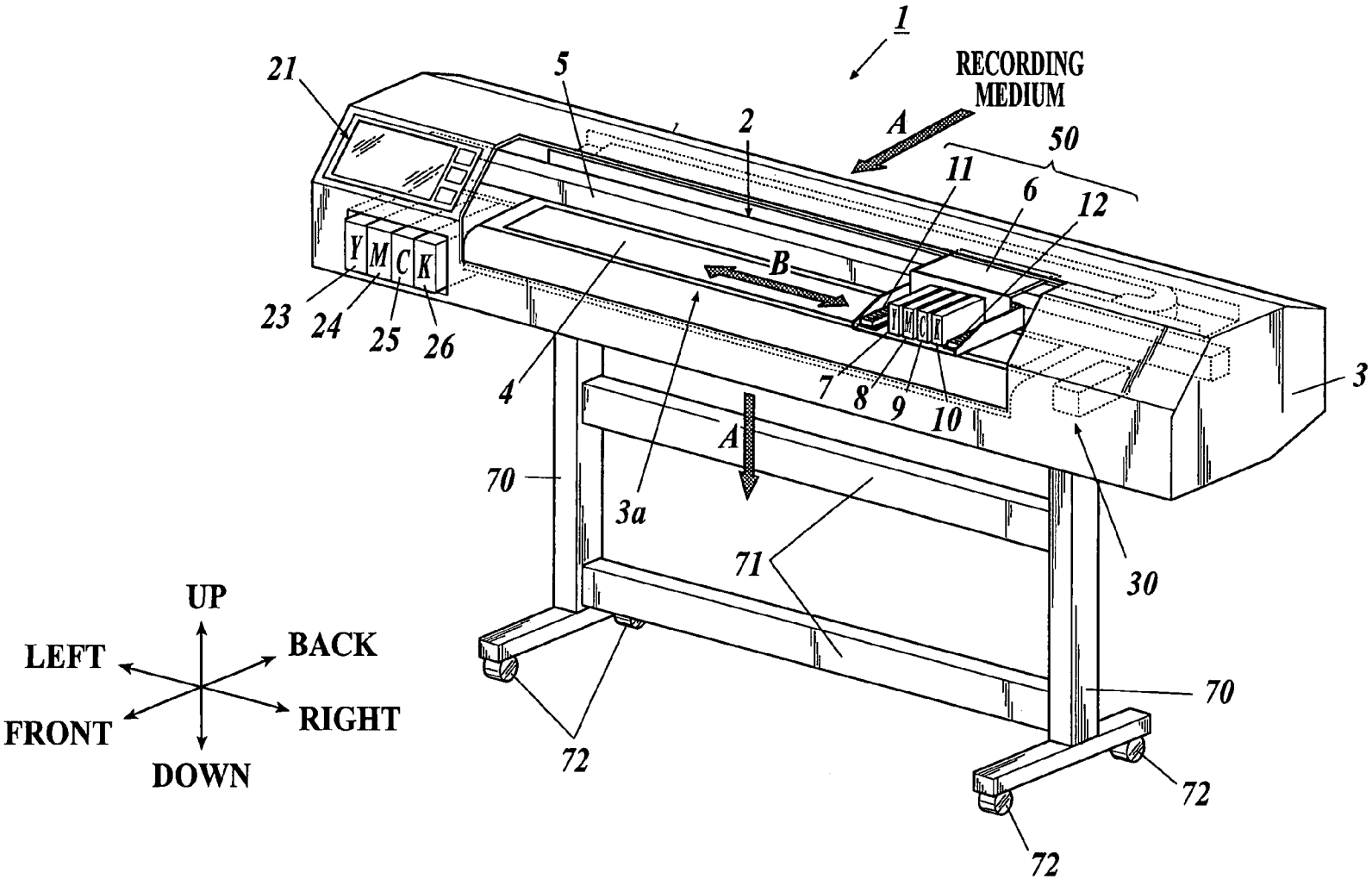
FIG. 1 is a perspective view of an ink jet printer.

Embodiments of an ink jet printer according to the present invention will be explained below referring to the drawings. However, the scope of the invention is not limited to the illustrations shown.

First Embodiment

First, the configuration of an ink jet printer 1 according to the present invention will be explained referring to FIGS. 1 to 4.

FIG. 1 is a perspective view of the ink jet printer 1.

As shown in FIG. 1, the ink jet printer 1 comprises an image recording portion 2 as a portion to execute an image recording operation to a recording medium. The image recording portion 2 is provided with various recording members for recording an image onto the recording medium. The image recording portion 2 is partly covered with a long case body 3 which extends in right and left direction and has polygonal right and left side surfaces. There is formed a square shaped opening 3*a* in the front side of the case body 3 when seen from the front, so that the recording operation at the image recording portion 2 is visible from the opening 3*a*. There is formed a slit like opening (not shown) for feeding the recording medium to the inside of the case body 3 in the back side of the case body 3.

The image recording portion 2 is provided with a long flat shaped platen 4 which extends in right and left direction. The platen 4 is for supporting the non-recording surface of the recording medium (the opposite side of the recording surface) in flat shape.

Although the recording medium is omitted in FIG. 1, the recording medium is fed from the carrying-in opening in the back side of the case body 3, being carried from back to front of the inside of the case body 3 by a carrying mechanism 22 (refer to FIG. 4) while the non-recording surface being supported by the platen 4, and is discharged to the outside of the case body 3. That is, the recording medium is carried along a carrying direction A (hereinafter, referred to as the sub scanning direction of a carriage 6) by the carrying mechanism 22 to pass through the inside of the case body 3.

A long guide member 5 which extends in right and left direction in the case body 3 is disposed above the platen 4. The guide member 5 is supported by the carriage 6. The carriage 6 is scannable (movable) along a scanning direction B extending in right and left direction (hereinafter, referred to as the scanning direction of the carriage 6) while being guided and supported by the guide member 5. The scanning direction B of the carriage 6 is perpendicular to the carrying direction A of the recording medium.

There are four recording heads 7-10 mounted on the carriage 6 in a state of being arranged in a line for discharging process colors of inks of yellow (Y), magenta (M), cyan (C) and black (B) to the recording medium. A plurality of nozzles (not shown) are arranged on the lower surface of each recording head 7-10. Each recording head 7-10 is adapted to discharge small ink droplets from the nozzles.

The "ink" used in the first embodiment will be explained.

The ink used in the first embodiment is a photo curable ink (ultraviolet ray curable ink) having a property to be cured by photo irradiation (ultraviolet ray irradiation) and including a polymerizable compound (including any publicly known polymerizable compound) such as oxetane compound, epoxy compound, vinyl ether compound and the like, photo initiator and color material as a main component.

The photo curable ink is classified into a radical polymerization ink containing a radical polymerizing compound and a cationic polymerization ink containing a cationic polymerizing compound, however, both of them can be applied as the ink to be used in the first embodiment. A hybrid type ink in which a radical polymerization ink and a cationic polymerization ink are combined can also be applied as the ink to be used in the first embodiment.

Next, the "recording medium" used in the first embodiment will be explained.

The recording medium used in the first embodiment may be an ink unabsorbent recording medium or an ink absorbent recording medium.

The term "absorbent" indicates that the recording medium does not absorb any ink compound, however, in the first embodiment, a recording medium through which 0 ml/mm$^2$ of ink is practically transferred when the amount of transferring ink in Bristow method is less than 0.1 ml/mm$^2$ is denoted as the unabsorbent recording medium. Other recording media are denoted as the absorbent recording medium.

As the unabsorbent recording medium, for example, various types of resin films used for flexible packaging can be employed in addition to a normal non-coated paper, coated paper or the like. Specific examples of types of resins of the resin films to be applied include polyethylene terephthalate, polyester, polyolefin, polyamide, polyester amide, polyether, polyimide, polyamideimide, polystyrene, polycarbonate, poly-ρ-phenylene sulfide, polyetherester, polyvinyl chloride, poly (meth) acrylic ester, polyethylene, polypropylene, nylon or the like. Further, copolymer, mixture, or bridge formation of these resins or the like can also be applied. Preferably, the unabsorbent recording medium has the surface energy of within the range of 35-60 mN/m, and more preferably, within the range of 40-60 mN/m. Examples of the absorbent recording medium includes, for example, a plane paper (copy paper), a good quality paper or the like.

As shown in FIG. 1, the carriage 6 is provided with an exposure section 50 for executing photo irradiation to cure the ink placed on the recording medium. The exposure section 50 comprises two light irradiating devices 11 and 12 for radiating light (ultraviolet ray) downward. The light irradiating devices 11 and 12 are arranged on left and right sides of the recording head group comprising the four recording heads 7-10, respectively.

Figure 2:
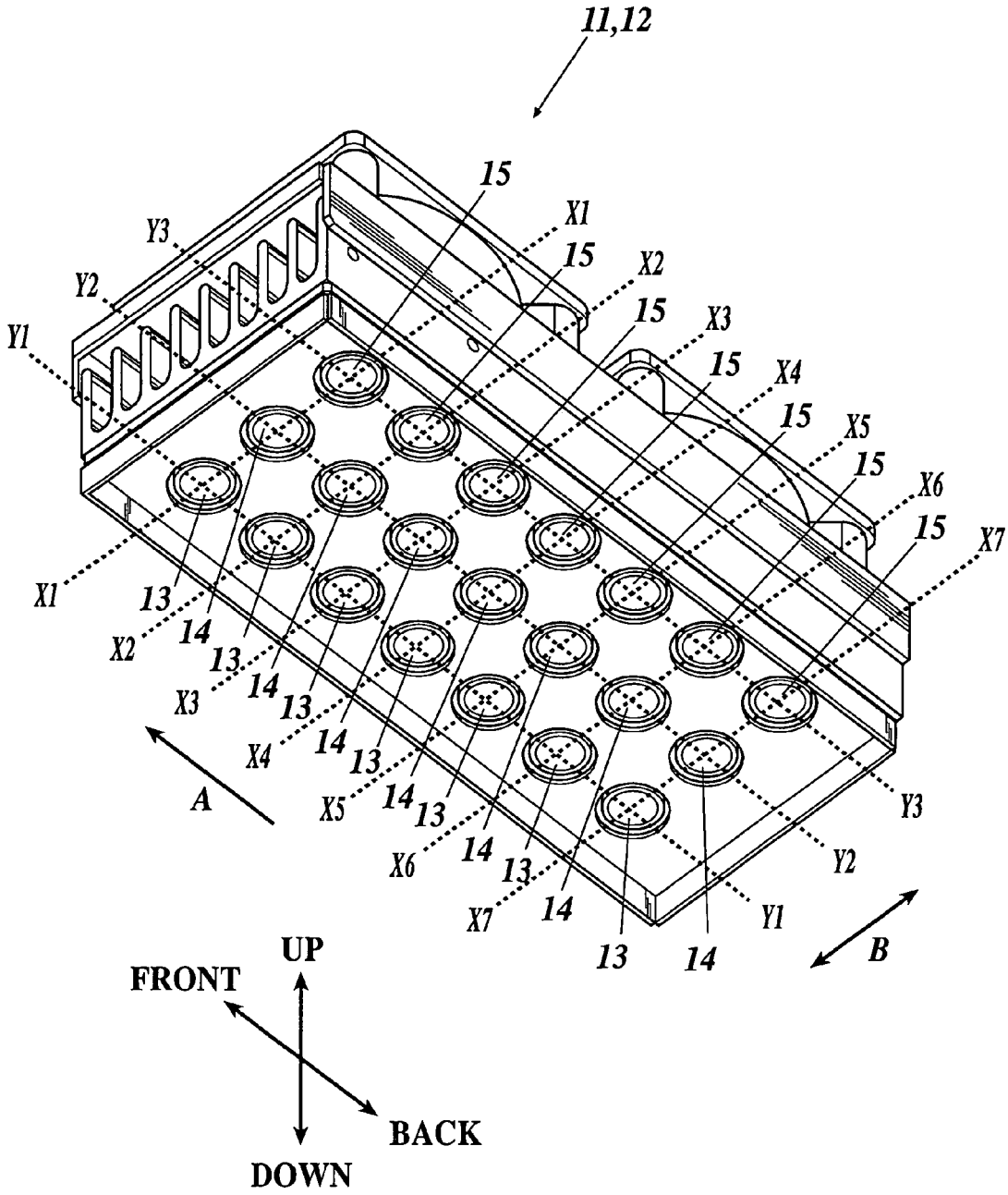
FIG. 2 is a perspective view of a light irradiating device.

FIG. 2 is a schematic view showing a configuration of the light irradiating device 11 when seen from the bottom.

As shown in FIG. 2, there are arranged a plurality of LEDs (Light Emitting Diode) 13, 13, . . . ; 14, 14, . . . ; 15, 15, . . . as a light source for radiating light (ultraviolet ray) at the lower portion of the light irradiating device 11. The light irradiating device 11 is adapted to radiate light downward with each of the LEDs 13, 14, 15 on. The LEDs 13 are arranged in a line along a line Y1 shown by a dotted line "Y1" in FIG. 2 at regular intervals. Similarly, the LEDs 14 are arranged in a line along a line Y2 shown by a dotted line "Y2" in FIG. 2 at regular intervals, and the LEDs 15 are arranged in a line along a line Y3 shown by a dotted line "Y3" in FIG. 2 at regular intervals. Each line Y1, Y2 and Y3 shown in FIG. 2 is along the carrying direction A of the recording medium shown in FIG. 1, thus, the LEDs 13 on the line Y1, the LEDs 14 on the line Y2 and the LEDs 15 on the line Y3 are arranged along the carrying direction A of the recording medium.

Also, a plurality of the LEDs 13, 13 . . . ; 14, 14 . . . ; 15, 15 . . . are arranged along rows X1 to X7 shown by dotted lines "X1 to X7" in FIG. 2. Each of the rows X1 to X7 shown in FIG. 2 is along the scanning direction B of the carriage 6, thus, the LEDS 13, 14, 15 of each of the rows X1 to X7 are along the scanning direction B of the carriage 6.

The explanation was made only for the light irradiating device 11 which is one of the light irradiating devices 11 and 12, however, the light irradiating device 12 has the same configuration as the light irradiating device 11.

Four ink tanks 23-26 are provided on the left side of the platen 4, which are for storing ink supplied to the four recording heads 7-10, respectively. The ink tanks 23-26 are connected to the recording heads 7-10 for discharging inks of Y, M, C, and K through supplying members (not shown) such as flexible tubes or the like, respectively. The ink is supplied from the ink tanks 23-26 to the recording heads 7-10, respectively, so that the ink with color corresponding to the color of the ink to be discharged from each recording head 7-10 is stored in each of the ink tanks 23-26.

A display panel 21 is provided above the ink tanks 23-26, which is for displaying recording modes which a user can select. The display panel 21 also functions as an input device from which a user can input the recording mode selected from the displayed recording modes.

On the right side of the platen 4 in FIG. 1, there is arranged an illumination intensity detector 30 for detecting an illumination intensity (irradiation intensity) of the light (ultraviolet ray) of each of the light irradiating devices 11 and 12.

Figure 3:
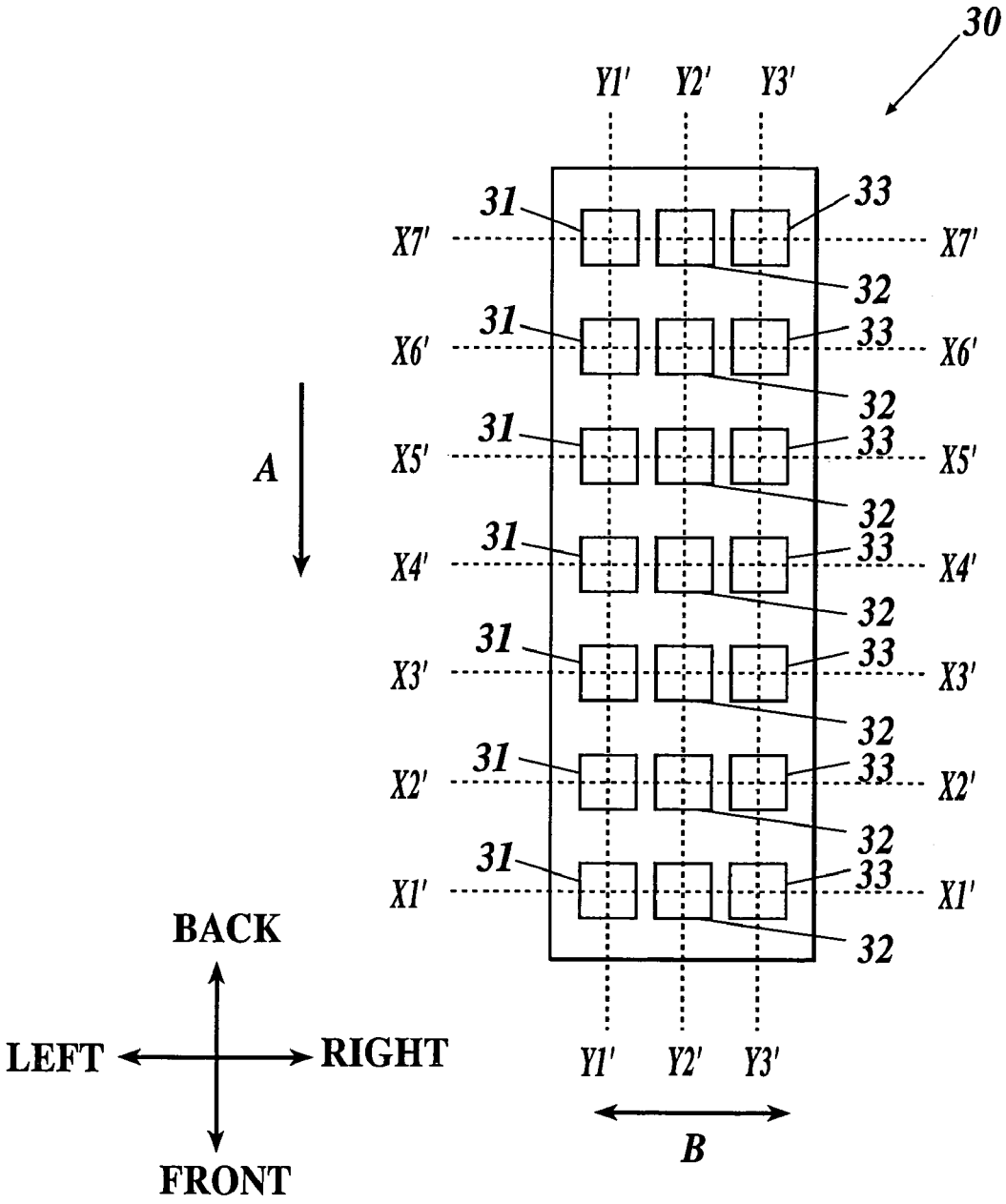
FIG. 3 is a plan view of an illumination intensity detector.

FIG. 3 is a plan view showing the illumination intensity detector 30.

As shown in FIG. 3, a plurality of sensors 31, 31, . . . ; 32, 32, . . . ; 33, 33, . . . for detecting illumination intensities (irradiation intensities) of light (ultraviolet ray) are arranged on the illumination intensity detector 30. The sensors 31 are arranged in a line along a line Y1' shown by a dotted line "Y1'" in FIG. 3 at regular intervals. Similarly, the sensors 32 are arranged in a line along a line Y2' shown by a dotted line "Y2'" in FIG. 3 at regular intervals, and the sensors 33 are arranged in a line along a line Y3' shown by a dotted line "Y3'" in FIG. 3 at regular intervals. Each of the lines Y1', Y2' and Y3' shown in FIG. 3 is along the carrying direction A of the recording medium shown in FIG. 1, thus, the sensors 31 on the line Y1', the sensors 32 on the line Y2' and the sensors 33 on the line Y3' are arranged along the carrying direction A of the recording medium.

A plurality of the sensors 31, 31 . . . ; 32, 32 . . . ; 33, 33 . . . are arranged along rows X1' to X7' shown by dotted lines "X1' to X7'" in FIG. 3. Each of the rows X1' to X7' shown in FIG. 3 is along the scanning direction B of the carriage 6, thus, the sensors 31, 32, and 33 of each of the rows X1' to X7' are along the scanning direction B of the carriage 6.

The illumination intensity detector 30 is fixedly arranged on the right side of the platen 4 and at the lower side of the moving path of each of the light irradiating devices 11 and 12 in FIG. 1. When each of the light irradiating devices 11 and 12 is positioned just above the illumination intensity detector 30, the lines Y1, Y2, and Y3 face the lines Y1', Y2', and Y3', respectively, and also the rows X1, X2, X3, X4, X5, X6, and X7 face the rows X1', X2', X3', X4', X5', X6', and X7', respectively.

In the first embodiment, with such configuration, the LEDs 13, 14, and 15 expressed by the lines Y1 to Y3 or the rows X1 to X7 correspond to the sensors 31, 32 and 33 expressed by the lines Y1' to Y3' or the rows X1' to X7', respectively, in a one-to-one relationship, so that the illumination intensity of the light radiated from each of the LEDs 13, 14, and 15 is detected by one of the sensors 31, 32, and 33 corresponding thereto.

As shown in FIG. 1, the ink jet printer 1 is supported by two inverted T shaped legs 70 at the lower portion of the image recording portion 2. Two reinforcing members 71 are crossed between the legs 70 to securely support the weights of various members, the ink tanks 23-26, the illumination intensity detector 30 and the like arranged in the image recording portion 2. Two casters 72 are provided at the lower portion of each leg 70. With such configuration, the ink jet printer 1 is movable back and forth and right and left.

Figure 4:
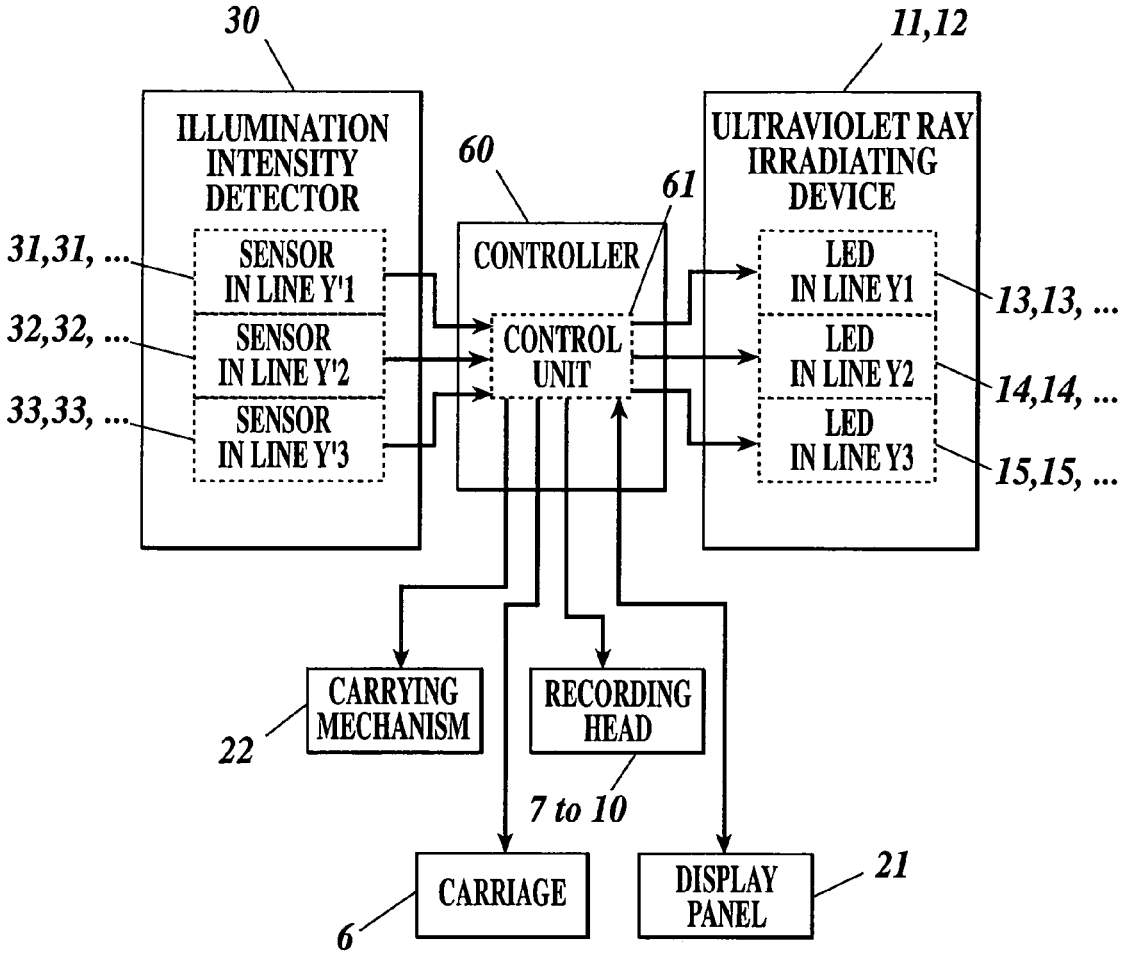
FIG. 4 is a block diagram showing a circuit configuration of the ink jet printer.

FIG. 4 is a block diagram showing a circuit configuration of the ink jet printer 1.

A control device 60 is for controlling the operation of the ink jet printer 1, and is incorporated in the ink jet printer 1. The control device 60 comprises a control unit 61 having general CPU (Central Processing Unit), ROM (Read Only Memory), RAM (Random Access Memory) and the like. In the control unit 61, the CPU expands the processing program recorded in the ROM to execute the processing program.

Connected to the control unit 61 are various members such as the carrying mechanism 22, the carriage 6, the recording heads 7-10, the light irradiating devices 11 and 12, and the like. Thus, the control unit 61 as a control section controls the operation of each component based on the operational condition of the various members.

Especially, in the connection of the control unit 61 and the light irradiating devices 11 and 12, each of the LEDs 13, 14, and 15 of each light irradiating device 11 and 12 is connected to the control unit 61 through the same drive circuit (driver) for each light irradiating device 11 and 12. The control unit 61 is adapted to control a power supply supplied to each of the LEDs 13, 14, and 15 for each of the light irradiating devices 11 and 12. That is, the control unit 61 can provide the same power supply to each of the LEDs 13, 14, and 15 for each of the light irradiating devices 11 and 12.

The control unit 61 (ROM or RAM) stores a data table in which the pre-recording conditions and the recording modes to be described later (1) to (3) corresponding to the pre-recording conditions are cited (refer to FIG. 6). The "pre-recording condition" is a condition which is set before recording an image, and specifically represents the type of ink, the type of a recording medium, the resolution of an image or the like. In the first embodiment, when the pre-recording condition is determined, the control unit 61 is adapted to select and execute one of the recording modes (1) to (3) to be described later corresponding to the pre-recording condition, and can control the members such as the carriage 6, the recording heads 7-10, the light irradiating devices 11 and 12, and the like with the recording mode which is selected and executed to record an image on the recording medium.

(1) "Normal Mode"

The normal mode is a recording mode in which a power supply to each of the LEDs 13, 14, and 15 of the light irradiating devices 11 and 12 and the scanning speed of the carriage 6 (relative moving speed to the recording medium) are fixed to predetermined values corresponding to the pre-recording condition. The normal mode is for giving a predetermined energy of photo irradiation to the ink landed on the recording medium to properly cure the ink when each of the LEDs 13, 14, and 15 is not deteriorated, or dirt such as ink mist or the like does not adhere to each of the LEDs 13, 14, and 15.

(2) "Speed Controlled Mode"

The speed controlled mode is a recording mode in which the scanning speed is slower than that in the normal mode. The speed controlled mode is for making the time duration of the light to which the ink is subjected long by making the scanning speed slower than that in the normal mode when the energy of the photo irradiation is insufficient for curing the ink placed on the recording medium.

(3) "Power Controlled Mode"

The power controlled mode is a recording mode in which the power supply is larger than that in the normal mode. The power controlled mode is for making the power supply to each of the LED 13, 14, and 15 larger than that in the normal mode when the energy of the photo irradiation is insufficient for curing the ink placed on the recording medium.

The degree of curing (curing property) of the ink depends upon the energy of the photo irradiation, and the "time duration" and the "illumination intensity" of the light to which the ink is subjected are determination factors for the energy of the photo irradiation. Thus, when executing the recording in the speed controlled mode, the time duration of the light to which the ink is subjected becomes long in comparison with the case of the normal mode, which necessarily results in increasing the energy of the photo irradiation to the ink if illumination intensities are same as each other. On the other hand, when executing the recording in the power controlled mode, the illumination intensity of the light to which the ink is subjected becomes large in comparison with the case of the normal mode, which necessarily results in increasing the energy of the photo irradiation to the ink if illumination intensities are same as each other. The "illumination intensity" of the light to which the ink is subjected is a factor relating to the quality of image recording, such as for judging that the ink is not cured or a proper ink diameter cannot be obtained if the ink is not irradiated with the light having the illumination intensity which is equal to or more than a predetermined threshold.

Each of the sensors 31, 32, and 33 of the illumination intensity detector 30 is connected to the control unit 61 through the individual drive circuit (driver). The control unit 61 controls each of the sensors 31, 32, and 33 to detect the illumination intensity of one of the LEDs 13, 14, and 15 corresponding thereto for each of the light irradiating devices 11 and 12, and produces a two-dimensional illumination intensity distribution (refer to FIG. 7) of the light of each of the light irradiating devices 11 and 12 based on the detected result.

Further, the control unit 61 is connected to a display panel 21, and is adapted to display the detected result of each of the LEDs 13, 14, and 15 of the illumination intensity detector 30 and a window (hereinafter, referred to as the "selection window") for a user to select the recording mode to the display panel 21 as a display section. When the user selects a recording mode from the selection window in a state that the selection window is displayed on the display panel 21, the display panel 21 functions as an input device to input the recording mode which was selected by the user to the control unit 61. The control unit 61 recognizes the content of the instructions from the selection and input operations by the user, and selects and executes the recognized recording mode.

The example was shown for the case of the selection and input operations on the display panel 21, however, the similar selection and input operations may be executed on a display panel of a computer system connected to the ink jet printer 1.

Next, an explanation of the operation of the ink jet printer 1 will be made referring to FIGS. 5 to 8.

Figure 5A:
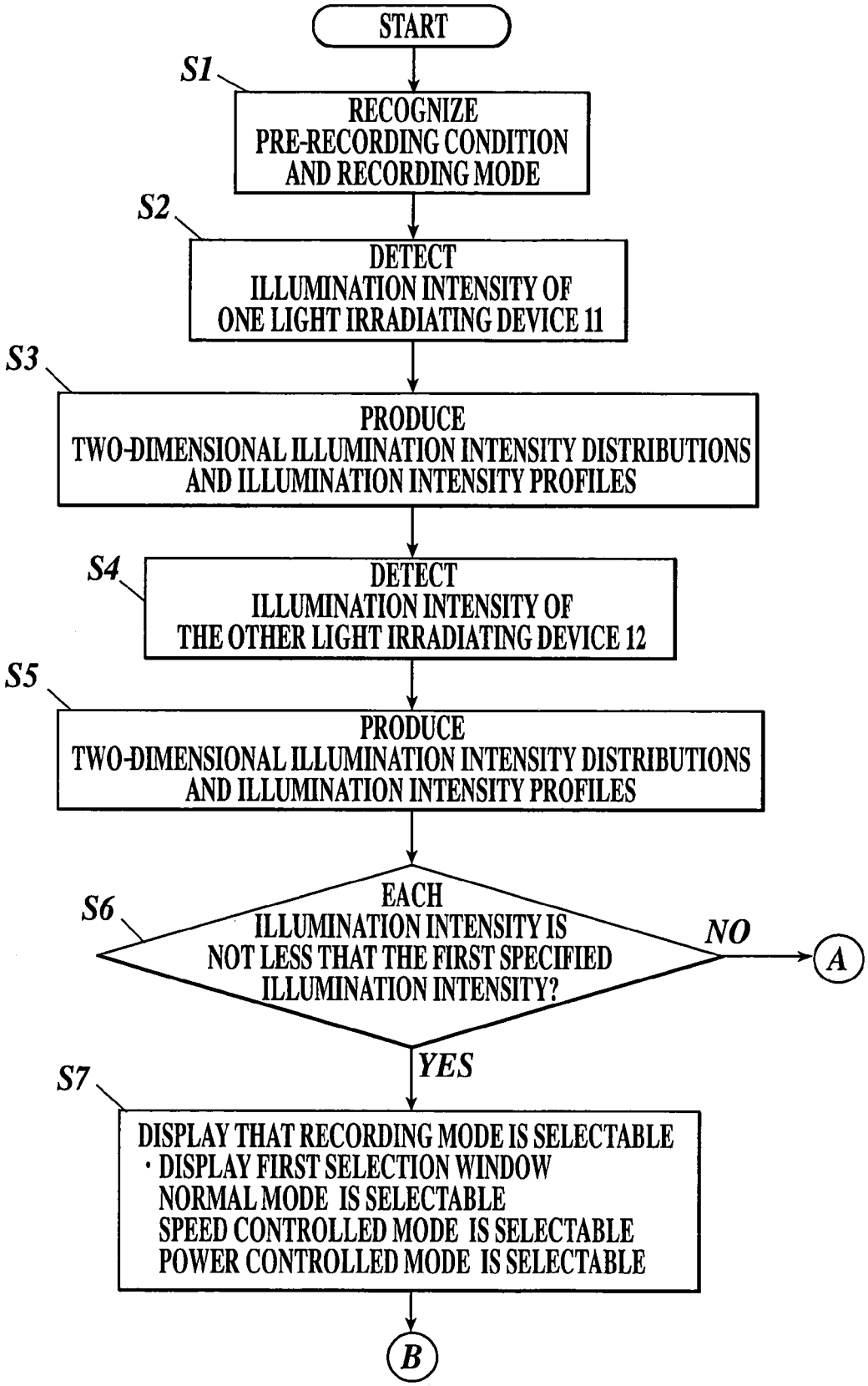
FIG. 5 is a flow chart showing each step of a recording mode display process with time.
Figure 5B:
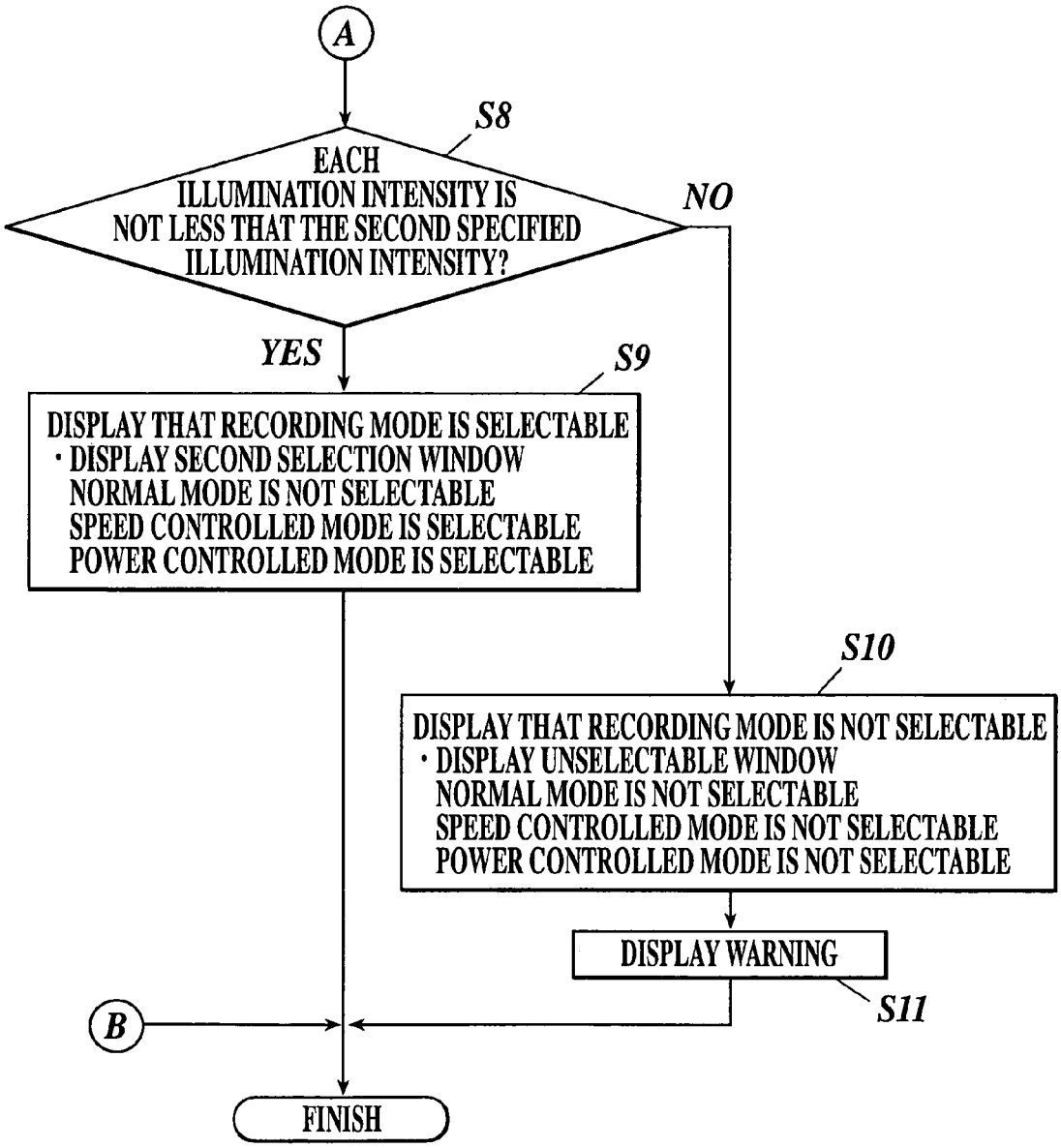

FIG. 5 is a flow chart showing each step of "a recording mode display process" executed by a control unit 61 (CPU) with time.

In the state prior to recording an image, when the pre-recording condition is input to the control unit 61 of the control device 60, the control unit 61 recognizes the pre-recording condition and also recognizes the recording mode corresponding to the pre-recording condition from the stored data table (Step S1).

FIG. 6 is a view showing an example of the time table.

FIG. 6 shows the recording modes according to the pre-recording condition, that is, the type of ink, the type of a recording medium and the resolution of an image. In FIG. 6, the type of ink, the type of a recording medium and the resolution of an image are shown as the pre-recording condition, however, a condition (for example, the size of a recording medium, temperature, humidity or the like) other than the above pre-recording condition may also be used as the pre-recording condition.

For example, when the control unit 61 which prestores the data table in FIG. 6 recognizes that the type of the ink is a "cationic polymerization ink", the type of the recording medium is a "resin film" and the resolution is "720(dpi)" as the pre-recording condition, the control unit 61 recognizes the following recording modes (4) to (6) which correspond to the pre-recording condition as the recording modes to be selected and executed.

(4) Normal Mode

The normal mode is a recording mode in which the scanning speed of the carriage 6 is "500 (mm/sec)" and the power supply to each of the LEDs 13, 14, and 15 is "25 (W)".

(5) Speed Controlled Mode

The speed controlled mode is a recording mode in which the scanning speed of the carriage 6 is "400 (mm/sec)" and the power supply to each of the LEDs 13, 14, and 15 is "25 (W)".

(6) Power Controlled Mode

The power controlled mode is a recording mode in which the scanning speed of the carriage 6 is "500 (mm/sec)" and the power supply to each of the LEDs 13, 14, and 15 is "30 (W)".

After finishing the process in the Step S1, the illumination intensity detection process of the light irradiating device 11 is executed (Step S2). Specifically, in the process in the Step S2, the carriage 6 is moved near the illumination intensity detector 30 to position the light irradiating device 11 just above the illumination intensity detector 30. In this state, each of the LEDs 13, 14, and 15 is on with the power supply in the normal mode, and the illumination intensity of the light of each of the LEDs 13, 14, and 15 is detected by one of the sensors 31, 32, and 33 corresponding thereto of the illumination intensity detector 30.

For example, when the control unit 61 which prestores the data table in FIG. 6 recognizes that the type the ink is a "cationic polymerization ink", the type of the recording medium is a "resin film", and the resolution is "720 (dpi)"

as the pre-recording condition, the control unit 61 makes each of the LEDs 13, 14, and 15 light up with the power supply of 25 (W) to detect the illumination intensity of each of the LEDs 13, 14, and 15.

After finishing the process in the Step S2, the two-dimensional illumination intensity distribution of the light of the light irradiating device 11 is produced based on the detected result of each of the LEDs 13, 14, and 15, and the illumination intensity profile of each of the lines Y1 to Y3 is produced based on the two-dimensional illumination intensity distribution (Step S3).

FIG. 7 is a view showing an example of the two-dimensional illumination intensity distribution.

As shown in FIG. 7, the two-dimensional illumination intensity distribution is a distribution, which is divided by the lines Y1 to Y3 and the rows X1 to X7, and in which an illumination intensity is assigned to each divided section base on the detected result of each of the LEDs 13, 14, and 15.

After producing the two-dimensional illumination intensity distributions as shown in FIG. 7, an illumination intensity profile of each of the lines Y1 to Y3 is produced based on the two-dimensional illumination intensity distributions.

Figure 8A:
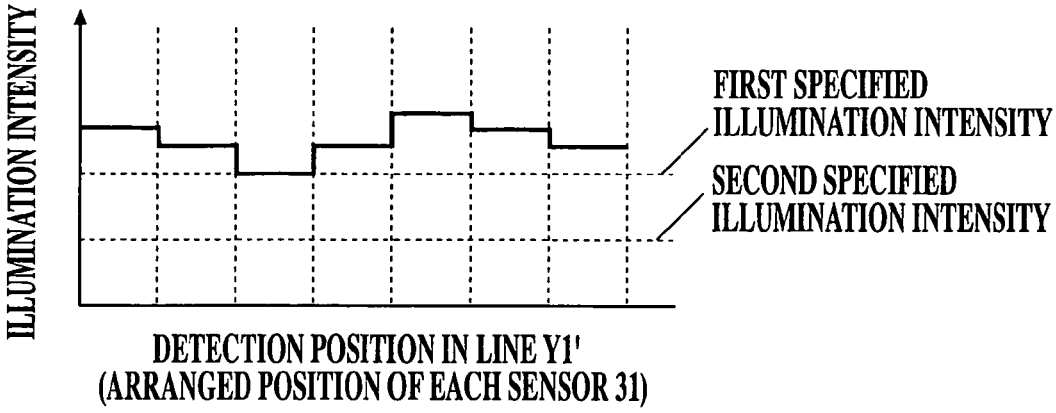
FIG. 8A is a view showing an example of an illumination intensity profile of a line Y1.
Figure 8B:
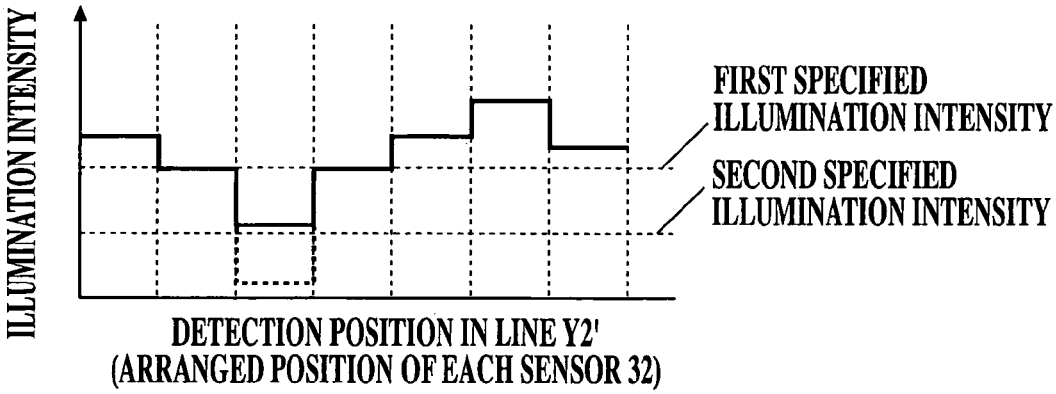
FIG. 8B is a view showing an example of an illumination intensity profile of a line Y2.
Figure 8C:
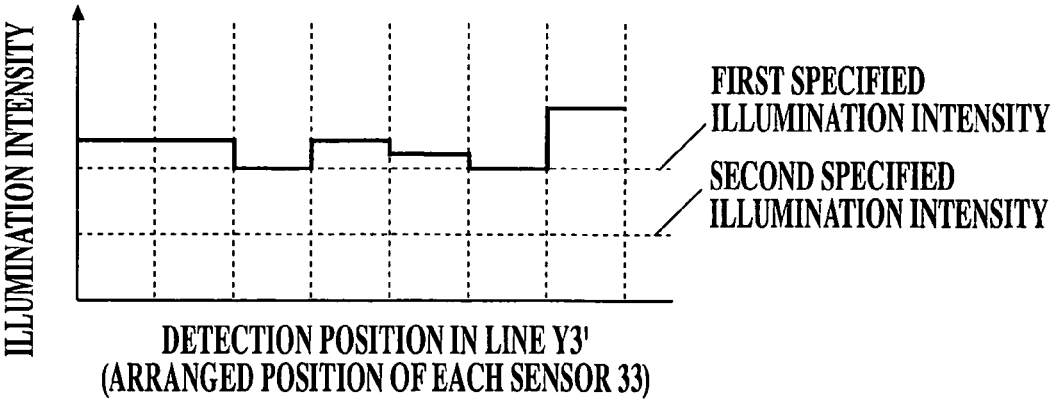
FIG. 8C is a view showing an example of an illumination intensity profile of a line Y3.

FIGS. 8A to 8C are views showing examples of the illumination intensity profiles of the lines Y1 to Y3. FIG. 8A shows the illumination intensity profile of the line Y1, FIG. 8B shows the illumination intensity profile of the line Y2, and FIG. 8C shows the illumination intensity profile of the line Y3.

As shown in FIGS. 8A to 8C, each illumination intensity profile shows the illumination intensities of the light at detection positions of the sensor 31, 32, or 33. Specifically, the illumination intensity profile in FIG. 8A shows the illumination intensities at arranged positions of the sensors 31 in the line Y1', the illumination intensity profile in FIG. 8B shows the illumination intensities at arranged positions of the sensors 32 in the line Y2', and the illumination intensity profile in FIG. 8C shows the illumination intensities at arranged positions of the sensors 33 in the line Y3'.

After finishing the process in the Step S3, the illumination intensity detection process of the light irradiating device 12 is executed similarly to the process in the above Step S2 (Step S4), and the two-dimensional illumination intensity distribution of the light of the light irradiating device 12 and the illumination intensity profiles of the lines Y1 to Y3 are produced similarly to the process in the above Step S3 (Step S5).

After finishing the process in the Step S5, the control unit 61 as the first judgment section judges for each of the lines Y1 to Y3 whether all illumination intensities in the illumination intensity profiles of the light irradiating device 11 are not less than the first specified illumination intensity or not referring to each illumination intensity profile of the light irradiating device 11. Similarly, the control unit 61 judges for each of the lines Y1 to Y3 whether all illumination intensities in the illumination intensity profiles of the light irradiating device 12 are not less than the first specified illumination intensity or not (Step S6).

The "first specified illumination intensity" is the illumination intensity which is about 70% (preferably, 90%) of the illumination intensity of light which is obtained when the power supply in the normal mode is applied to each of the LEDs 13, 14, and 15. The photo irradiation to the ink with the illumination intensity not less than the first specified illumination intensity is successful in obtaining the energy of the photo irradiation which is sufficient to properly cure the ink by multiplying the illumination intensity of the light to which the ink is subjected by the time duration of the light to which the ink is subjected when the carriage 6 is scanned with the scanning speed in the normal speed. The degree of the illumination intensity of light for specifying the first specified illumination intensity is previously set, which can appropriately be changed by the panel operation or the like on the display panel 21. The degree of the previously set illumination intensity of light is stored in the control unit 61 (ROM or RAM).

In the process in the Step S6, when the control unit 61 judges that all the illumination intensities in each illumination intensity profile of the light irradiating devices 11 and 12 are not less than the first specified illumination intensity (Step S6; Yes), the control unit 61 judges that "being below the first illumination intensity" does not occur in the light irradiating devices 11 and 12. For example, in the processes in the Steps S3 and S5, when the illumination intensity profile as shown in FIG. 8A or 8C is produced, the control unit 61 judges that the illumination intensities in the illumination intensity profile are not less than the first specified illumination intensity, thereby judging that being below the first illumination intensity does not occur in the two light irradiating devices 11 and 12.

When the control unit 61 judges that being below the first illumination intensity does not occur, the control unit 61 displays the window (hereinafter, referred to as the "first selection window") for selecting one of the recording modes of the normal mode, the speed controlled mode and the power controlled mode on the display panel 21 (Step S7) to finish the recording mode display process.

On the other hand, in the process in the Step S6, when the control unit 61 judged that there is an illumination intensity which is less than the first specified illumination intensity in the illumination intensity profiles (Step S6; No), the control unit 61 judges that being below the first illumination intensity occurs in at least one of the light irradiating devices 11 and 12. For example, in the processes in the Steps S3 and S5, when the illumination intensity profile as shown in FIG. 8B (the solid line part in the figure) is produced, the control unit 61 judges that there is an illumination intensity which is less than the first specified illumination intensity in the illumination intensity profile, thereby judging that being below the first illumination intensity occurs in at least one of the two light irradiating devices 11 and 12.

When the control unit 61 judges that being below the first illumination intensity occurs, the second judgment section judges whether all illumination intensities in each illumination intensity profile of the light irradiating devices 11 and 12 are not less than the second specified illumination intensity or not similarly to the process in the above Step S6 (Step S8).

The "second specified illumination intensity" is the illumination intensity which is lower than the first specified illumination intensity and is the minimum required illumination intensity to cure the ink or obtain a proper ink dot diameter (or to obtain an excellent image) in addition to the ink curing. The second specified illumination intensity is previously set and can appropriately be changed by the panel operation or the like on the display panel 21. The previously set second specified illumination intensity is stored in the control unit 61 (ROM or RAM).

In the process in the Step S8, when the control unit 61 judges that all the illumination intensities in each illumination intensity profile of the light irradiating devices 11 and 12 are not less than the second specified illumination intensity (Step S8; Yes), the control unit 61 judges that "being below the second illumination intensity" does not occur in the light irradiating devices 11 and 12. For example, in the processes in the Steps S3 and S5, when the illumination intensity profiles as shown in FIGS. 8A to 8C (the solid line part in FIG. 8B) are produced, the control unit 61 judges that the illumination intensities in the illumination intensity profiles are not less than the second specified illumination intensity, thereby judging that being below the second illumination intensity does not occur in the two light irradiating devices 11 and 12.

When the control unit 61 judges that being below the second illumination intensity does not occur, the control unit 61 displays the window (hereinafter, referred to as the "second selection window") for selecting one of the recording modes of the speed controlled mode and the power controlled mode on the display panel 21 (Step S9) to finish the recording mode display process. In the process in the Step S9, the normal mode is not displayed on the display panel 21 as a display item, which is different from the process in the Step S7.

On the other hand, in the process in the Step S8, when the control unit 61 judged that there is an illumination intensity which is less than the second specified illumination intensity in the illumination intensity profiles (Step S8; No), the control unit 61 judges that being below the second illumination intensity occurs in at least one of the light irradiating devices 11 and 12. For example, in the processes in the Steps S3 and S5, when the illumination intensity profile as shown in FIG. 8B (the dotted line part in the figure) is produced, the control unit 61 judges that there is an illumination intensity which is less than the second specified illumination intensity in the illumination intensity profile, thereby judging that being below the second illumination intensity occurs in at least one of the two light irradiating devices 11 and 12.

When the control unit 61 judges that being below the second illumination intensity occurs, the control unit 61 displays the window (hereinafter, referred to as the "unselectable window") for indicating that any recording mode of the normal mode, the speed controlled mode, and the power controlled mode cannot be selected on the display panel 21 (Step S10).

After finishing the process in the Step S10, the control unit 61 specifies a light irradiating device relating to the judgment result of being below the second illumination intensity and an LED in the light irradiating device based on the all illumination intensity profiles produced in the processes in the Steps S3 and S5, and displays the window (hereinafter, referred to as the "warning window") on the display panel 21 in which all or a part of the following (1) to (8) items are expressed by using characters, symbols, images or the like to finish the recording mode display process. That is, in the process in the Step S11, the display panel 21 functions as the warning section to warn a user that the illumination intensity of the light from any of the LEDs 13, 14, and 15 is significantly decreased in a way of display.

(1) Produced two-dimensional illumination intensity distribution (refer to FIG. 7)

(2) Typically expressed two-dimensional illumination intensity distribution which was produced (3) Illumination intensity profile of each of the lines Y1 to Y3 (refer to FIGS. 8A to 8C)

(4) Irradiation conditions of the light of the light irradiating devices 11 and 12 (characters such as "good", "bad" or "partly bad", or symbols expressing them)

(5) Information indicating that being below the first illumination intensity and/or being below the second illumination intensity occur(s) in at least one of the light irradiating devices 11 and 12

(6) Portion which is judged that being below the first illumination intensity and/or being below the second illumination intensity occur(s) in at least one of the light irradiating devices 11 and 12

(7) The light irradiating device which is judged that being below the first illumination intensity and/or being below the second illumination intensity occur(s)

(8) The LED which is specified that being below the first illumination intensity and/or being below the second illumination intensity occurs The explanation of the displayed items on the display panel 21 was made, however, the configuration may be such that these items are displayed on a display panel of a computer connected to the ink jet printer 1.

In the condition where the above recording mode display process is finished, when the first selection window is displayed on the display panel 21, the condition becomes to be able to select one of the recording modes of the normal mode, the speed controlled mode, and the power controlled mode. When the second selection window is displayed on the display panel 21, the condition becomes to enable a user to select one of the recording modes of the speed controlled mode and the power controlled mode. When the unselectable window is displayed on the display panel 21, the user cannot select any of the recording modes of the normal mode, the speed controlled mode, and the power controlled mode, that is, the control unit 61 prohibits an image to be recorded.

In the condition of displaying the first or second selection window, when the user selects a recording mode from the display panel 21, the input information is input to the control unit 61 of the control device 60, and the control device 60 selects and executes the recording mode corresponding to the selection and input operations by the user to thereby start the recording operation of an image.

When the recording operation is started, the carrying mechanism 22 is actuated, so that the recording medium which was fed from the carrying-in opening of the case body 3 to the inside thereof is carried along the carrying direction A while the non-recording surface being supported by the platen 4 in the case body 3. With this operation, the carriage 6 is actuated to reciprocate along the scanning direction B just above the recording medium, so that the recording heads 7-10 and the two light irradiating devices 11 and 12 also move following the reciprocating movement of the carriage 6.

In this state, each of the recording heads 7-10 discharges ink to the recording surface of the recording medium, and each of the LEDs 13, 14, and 15 of the light irradiating devices 11 and 12 lights up to irradiate the recording surface of the recording medium with the light from each of the light irradiating devices 11 and 12. In this case, when the carriage 6 scans from left to right in FIG. 1, each of the LEDs 13, 14, and 15 of the light irradiating device 11 lights up, and on the contrary, when the carriage 6 scans from right to left in FIG. 1, each of the LEDs 13, 14, and 15 of the light irradiating device 12 lights up. That is, the carriage 6 functions as a moving section to move each of the light irradiating devices 11 and 12 relative to the recording medium. While the carriage 6 is scanning, each of the LEDs 13, 14, and 15 of one of the light irradiating devices 11 and 12 on the back side of the recording heads 7-10 in the scanning direction B of the carriage 6 lights up.

The method to perform the relative movement of the light irradiating devices 11 and 12 and the recording medium is not limited to the above example. By making the carrying mechanism 22 function as a moving section, the recording medium may be moved in a state where the light irradiating devices 11 and 12 are fixed, or by making the carriage 6 function as a moving section, the light irradiating devices 11 and 12 may be scanned in a state where the recording medium is stopped. Further, by making both of the carrying mechanism 22 and the carriage 6 function as a moving section, the light irradiating devices 11 and 12 may be scanned and the recording medium may be carried simultaneously.

When the control unit 61 selects and executes the speed controlled mode, the carriage 6 reciprocatingly scans at the scanning speed slower than that in the power controlled mode, enabling to extend the duration time of the light to which the ink is subjected more than normal. On the other hand, when the control unit 61 selects and executes the power controlled mode, each of the LEDs 13, 14, and 15 is supplied with the power supply more than that in the normal mode or the power controlled mode, enabling to make the illumination intensity of he light to be radiated to the ink larger than normal.

With such configuration, the ink is discharged from each of the recording heads 7-10, and then irradiated with light immediately after the ink discharged was placed onto the recording surface of the recording medium to be immediately cured, thereby recording a desired image with numerous dots of each process color on the recording surface in order. Thereafter, when the predetermined number of images are recorded (or when the carriage 6 finishes the predetermined number of scanning), the ink jet printer 1 repeats the recording mode display process and the image recording operation.

In the first embodiment, when there is an illumination intensity which is less than the first specified illumination intensity in the illumination intensity profiles produced by the control unit 61, the second selection window is displayed on the display panel 21, and an image is recorded in substantially one of the recording modes of the speed controlled mode and the power controlled mode by a users' selection and input operations. Thus, while recording an image, the ink is irradiated with the light having the energy of photo irradiation enough to properly cure the ink, which is successful in properly curing the ink and obtaining an image of good quality.

The present invention is not limited to the first embodiment, and various improvements and design changes may be made without departing from the spirit of the present invention as follows.

As one of the improvements and design changes, although the illumination intensities of light are detected in a state where the light irradiating devices 11 and 12 and the illumination intensity detector 30 are stopped in the processes in the Steps S2 and S4, the illumination intensities of light may be detected by moving the light irradiating devices 11 and 12 and the illumination intensity detector 30 relative to each other.

As another improvement and design change, the control unit 61 may automatically select and execute the normal mode to start the image recording operation without displaying the first selection window in the process in the Step S7.

That is, the normal mode may be set as a default recording mode of the control device 60 (control unit 61), or may be set as the most preferentially selected and executed recording mode, so that the control unit 61 always selects and executes the normal mode to start the image recording operation under the condition where the image recording operation can be executed in the normal mode (when the process in the Step S7 is executed).

Under such condition, when the image recording operation is executed in the normal mode, and the process in the Step S9 is executed in the following recording mode display process, the second selection window is displayed on the display panel 21, so that the recording condition can be changed to the speed controlled mode or to the power controlled mode from the normal recording mode (the recording mode may be forcibly changed to the speed controlled mode or the power controlled mode from the normal recording mode in the process in the Step S9). In this case, when the recording mode display process and the image recording operation are executed every time the carriage 6 finishes the predetermined number of scanning, even if there is an illumination intensity in the light irradiating devices 11 and 12 which is less than the first specified illumination intensity and not less than the second specified illumination intensity while recording an image in the normal mode, the active jobs of image recording operations can be completed, which is beneficial.

As yet another improvement and design change, the control unit 61 may automatically select and execute one of the recording modes of the speed controlled mode and the power controlled mode to start the image recording operation without displaying the second selection window in the process in the Step S9.

As yet another improvement and design change, when the control unit 61 selects and executes the power controlled mode to execute the image recording operation after the process in the Step S9, and then the process in the Step S9 is executed again in the recording mode display process, the window in which only the speed controlled mode can be selected (hereinafter, referred to as the "third selection window") may be displayed on the display panel 21 (the second selection window is not displayed on the display panel 21), so that a user can select and input only the speed controlled mode. In this case, the control unit 61 may automatically select and execute the speed controlled mode without displaying the third selection window to start the image recording operation.

As yet another improvement and design change, in the processes in the Steps S10 and S11, only the warning window may be displayed without displaying the unselectable window, and the control unit 61 may automatically stop the operations of the carrying mechanism 22, the carriage 6, the recording heads 7-10, the light irradiating devices 11 and 12 or the like to thereby prohibit the image recording.

As yet another improvement and design change, when the control unit 61 selects and executes the power controlled mode, only the light irradiating device having an LED causing to be below the first illumination intensity (or the LED) may be supplied with the power supply in the power controlled mode.

As yet another improvement and design change, each of the LEDs 13, 14, and 15 of the light irradiating devices 11 and 12 may be connected to the control unit 61 through the individual drive circuit, and when the control unit 61 selects and executes the power controlled mode, only the LED 13, 14, or 15 which causes to be below the first illumination intensity may be supplied with the power supply in the power controlled mode.

In the above first embodiment, illumination intensities of the light of the light irradiating devices 11 and 12 are detected for each of the light irradiating devices 11 and 12, and the judgment is made whether the detected illumination intensities are not less than the first specified illumination intensity for each of the light irradiating devices 11 and 12. When there is the light irradiating device 11 or 12 having an illumination intensity less than the first specified illumination intensity, an example to control the energy of the photo irradiation to which the ink is subjected based on the illumination intensity of the light of the light irradiating device is shown. As the control method of the energy of the photo irradiation, there are shown the method to make the illumination intensity of the light to which the ink is subjected large and the method to extend the duration time of the light to which the ink is subjected, so that the illumination intensity less than the first specified illumination intensity is controlled to exceed the first specified illumination intensity. However, as yet another improvement and design change, the present invention is not limited thereto. That is, the control method may be one in which, in light of the light sources (LEDs 13, 14, and 15) of the light irradiating devices 11 and 12, the illumination intensity of light is detected for each light source, the judgment is made whether the detected illumination intensity is not less than the first specified illumination intensity for each light source. When there is a light source having an illumination intensity less than the first specified illumination intensity, the energy of the photo irradiation to which the ink is subjected is controlled based on the illumination intensity of the light of the light source. In the case where the exposure section comprises one light irradiating device having a plurality of light sources, the illumination intensity of light is detected for each light source. Thus, when the light irradiating device comprises only one light source, the illumination intensity of light of a portion of the light source may be detected.

As yet another improvement and design change, the above described step of selecting the recording mode based on the detected result of the illumination intensity may be executed every time the predetermined number of images are recorded, may be executed before starting the image recording operation, or may be executed when a user inputs from the display panel 21.

Second Embodiment

Figure 9:
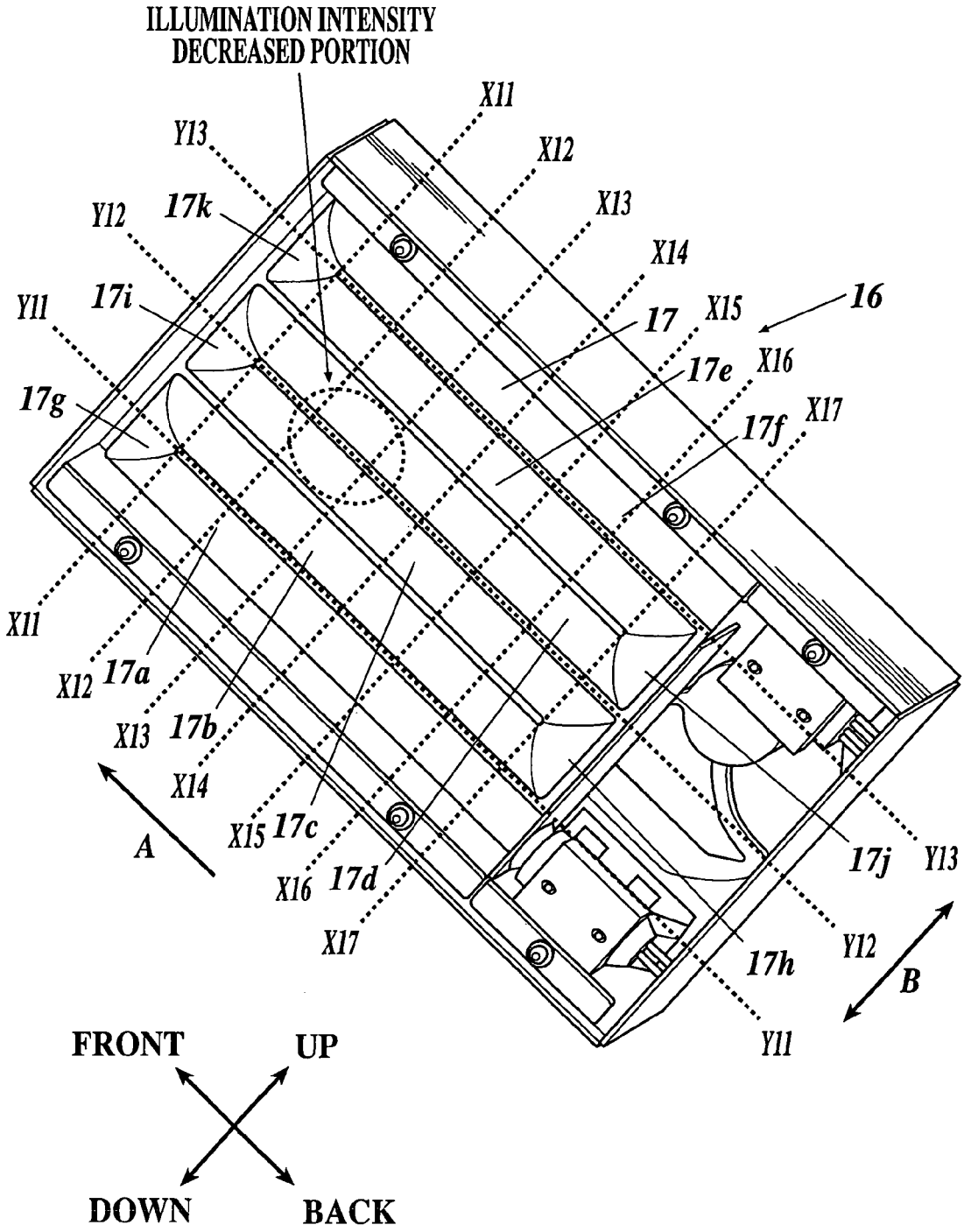
FIG. 9 is a perspective view showing a light irradiating device according to the second embodiment.

In the second embodiment, light irradiating devices 16 shown in FIG. 9 are applied instead of the light irradiating devices 11 and 12 shown in FIG. 2, and other components (including the ink and the recording medium to be applied, and the improvements and changes designs) are same as those in the first embodiment.

The explanation will be made of the points different from the first embodiment below.

FIG. 9 is a perspective view of the light irradiating device 16 when seen from the bottom.

As shown in FIG. 9, an electric discharge tube 17 is arranged as a light source to radiate light (ultraviolet ray) at the bottom of the light irradiating device 16. The electric discharge tube 17 comprises a plurality of longer portions 17*a*-17*f* and a plurality of shorter portion 17*g*-17*k* which are alternately connected with each other to have a zigzag shape as a whole. The longer portions 17*a*-17*f* of the electric discharge tube 17 are parallel with each other along the carrying direction A of the recording medium, and the shorter portions 17*g*-17*k* of the electric discharge tube 17 are parallel with each other along the scanning direction A of the carriage 6.

When the light irradiating device 16 is positioned just above the illumination intensity detector 30, a line Y11 shown by a dotted line "Y11" in FIG. 9 faces the line Y1' of the illumination intensity detector 30, a line Y12 shown by a dotted line "Y12" in FIG. 9 faces the line Y2' of the illumination intensity detector 30, and a line Y13 shown by a dotted line "Y13" in FIG. 9 faces the line Y3' of the illumination intensity detector 30. Also, a row X11 shown by a dotted line "X11" in FIG. 9 faces the row X1' of the illumination intensity detector 30, a row X12 shown by a dotted line "X12" in FIG. 9 faces the row X2' of the illumination intensity detector 30, a row X13 shown by a dotted line "X13" in FIG. 9 faces the row X3' of the illumination intensity detector 30, a row X14 shown by a dotted line "X14" in FIG. 9 faces the row X4' of the illumination intensity detector 30, a row X15 shown by a dotted line "X15" in FIG. 9 faces the row X5' of the illumination intensity detector 30, a row X16 shown by a dotted line "X16" in FIG. 9 faces the row X6' of the illumination intensity detector 30, and a row X17 shown by a dotted line "X17" in FIG. 9 faces the row X7' of the illumination intensity detector 30.

In the circuit configuration shown in FIG. 4, the electric discharge tube 17 of each light irradiating device 16 is connected to the control unit 61 through the individual drive circuit (driver), and the control unit 61 is adapted to control the power supply for each light irradiating device 16 (electric discharge tube 17). That is, the control unit 61 can supply a different power supply to each light irradiating device 16 (electric discharge tube 17).

In the recording mode display process shown in FIG. 5, in the process in the Step S11, the control unit 61 specifies the light irradiating device causing to be below the second illumination intensity and an illumination intensity decreased portion (refer to the circle in FIG. 9) in the electric discharge tube 17 of the light irradiating device, and displays all or a part of the following (21) to (27) items expressed by using characters, symbols, images or the like as the warning window.

(21) Produced two-dimensional illumination intensity distribution (refer to FIG. 7)

(22) Typically expressed two-dimensional illumination intensity distribution which was produced

(23) Illumination intensity profile of each of the lines Y11 to Y13 (refer to FIGS. 8A to 8C)

(24) Irradiation conditions of the light of each light irradiating device 16 (characters such as "good", "bad" or "partly bad", or symbols expressing them)

(25) Information indicating that being below the first illumination intensity and/or being below the second illumination intensity occur(s) in at least one of the light irradiating devices 16

(26) Portion which is specified that being below the first illumination intensity and/or being below the second illumination intensity occur(s) in at least one of the light irradiating devices 16

(27) The light irradiating device which is specified that being below the first illumination intensity and/or being below the second illumination intensity occur(s)

In the image recording operation, when the control unit 61 selects and executes the power controlled mode, the electric discharge tube 17 of each light irradiating device 16 is supplied with the same power supply in the power controlled mode.

Similar to the first embodiment, in the above second embodiment, when there is an illumination intensity which is less than the first specified illumination intensity in the illumination intensity profiles produced by the control unit 61, the second selection window is displayed on the display panel 21, and an image is recorded in substantially one of the recording modes of the speed controlled mode and the power controlled mode by a users' selection and input operations. Thus, while recording an image, the ink is irradiated with the light having the energy of photo irradiation enough to properly cure the ink, which is successful in properly curing the ink and obtaining an image of good quality.

The present invention is not limited to the second embodiment, and various improvements and design changes may be made without departing from the spirit of the present invention as follows.

As one of the improvements and design changes, when the control unit 61 selects and executes the power controlled mode, only the light irradiating device having an electric discharge tube causing to be below the first illumination intensity (or the electric discharge tube) may be supplied with the power-supply in the power controlled mode.

In the second embodiment, illumination intensities of the light of each electric discharge tube 17 are detected for the three lines Y11 to Y13 corresponding to the number of lines of the sensors (sensors 31, 32, and 33) of the illumination intensity detector 30. However, as another improvement and design change, the number of lines of the sensors may be the same as the number of the longer portions 17*a*-17*f*, so that the illumination intensity of the light of each of the longer portions 17*a*-17*f* is detected by the sensors in one of the lines corresponding thereto.

As yet another improvement and design change, in the second embodiment, although each light irradiating device 16 is provided with one light source (electric discharge tube 17) having a zigzag shape, one line shaped light source may be provided or two or more line shaped light sources may be provided in two or more lines.

Third Embodiment

Figure 10A:
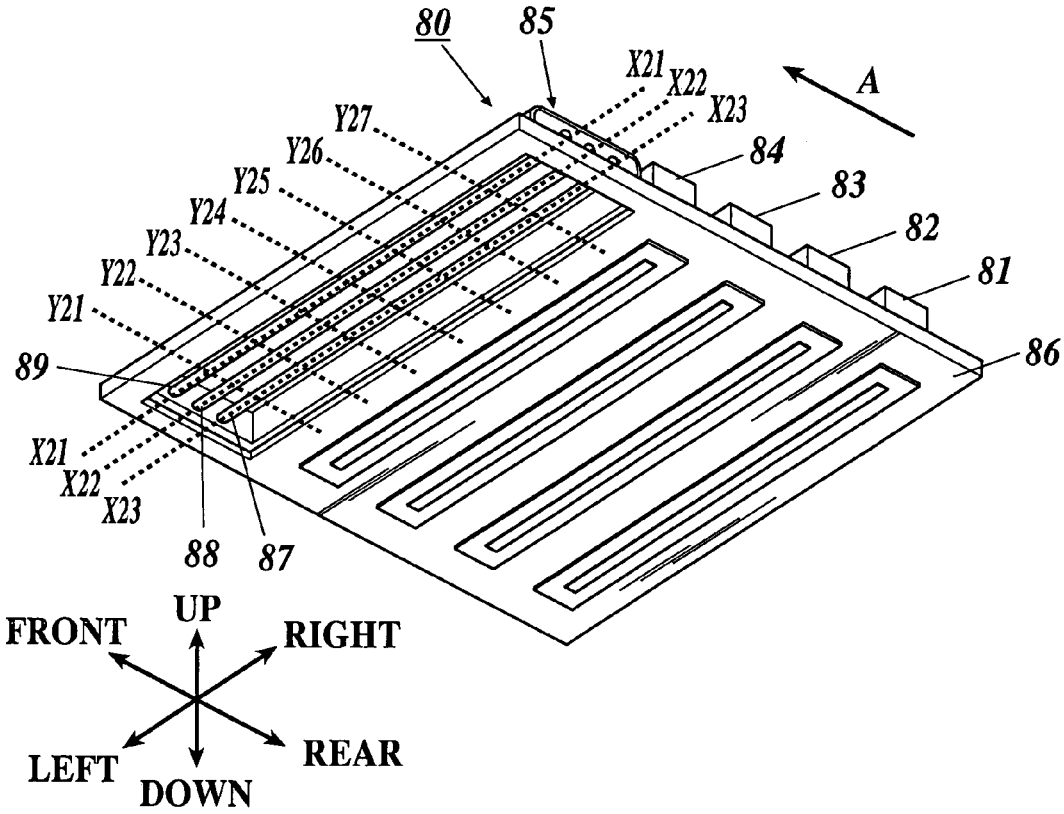
FIG. 10A is a schematic view showing a recording member according to the third embodiment.
Figure 10B:
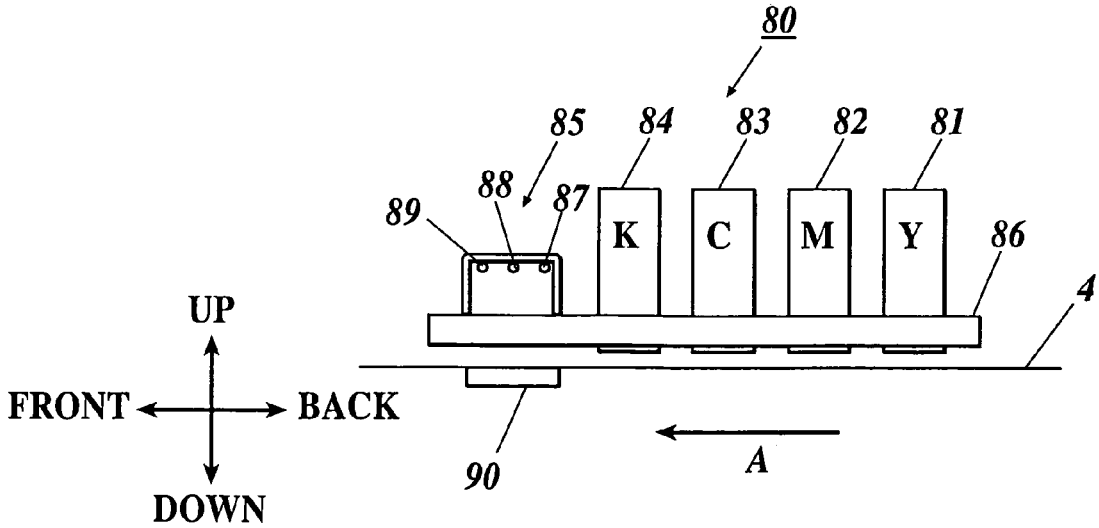
FIG. 10B is a side view showing the recording member according to the third embodiment.

In the third embodiment, the mode (line type) in which a recording member 80 shown in FIGS. 10A and 10B is applied instead of the mode (serial type) in which the carriage 6 mounting the recording heads 7-10 and the light irradiating devices 11 and 12 scans along the guide member 5. Other components (including the ink and the recording medium to be applied, and the improvements and design changes) are same as those in the first embodiment.

The explanation will be made of the points different from the first embodiment below.

FIG. 10A is a perspective view of the recording member 80 when seen from the bottom, and FIG. 10B is a side view of the recording member 80.

As shown in FIGS. 10A and 10B, the recording member 80 comprises four recording heads 81-84 for discharging inks of Y, M, C, and K, and a light irradiating device 85 for radiating light (ultraviolet ray) downward. A support member 86 supports and fixes the recording heads 81-84 and the light irradiating device 85. The recording member 80 is fixed just above the platen 4.

Each of the recording heads 81-84 is a publicly known line head, and extends in a direction perpendicular to the carrying direction A of the recording medium. The length of each of the recording heads 81-84 in the extending direction is approximately equal to the width of the platen 4.

The light irradiating device 85 is arranged on the downstream side of the recording head 84 in the carrying direction A of the recording medium, and comprises three electric discharge tubes 87-89 as a light source for radiating light (ultraviolet ray). Each of the electric discharge tubes 87-89 extends in a direction perpendicular to the carrying direction A of the recording medium, and has a length along the extending direction approximately equal to the width of the platen 4.

A row X21 shown by a dotted line "X21" in FIG. 10A is along the length direction of the electric discharge tube 89, a row X22 shown by a dotted line "X22" in FIG. 10A is along the length direction of the electric discharge tube 88, and a row X23 shown by a dotted line "X23" in FIG. 10A is along the length direction of the electric discharge tube 87. Lines Y21 to Y27 shown by dotted lines "Y21 to Y27" in FIG. 10A are along the carrying direction A of the recording medium, and are spaced with each other at equal intervals.

As shown in FIG. 10B, the platen 4 is provided with an illumination intensity detector 90 for detecting an illumination intensity of the light (ultraviolet ray) of the light irradiating device 85 to be arranged at a position to face the light irradiating device 85.

Figure 11:
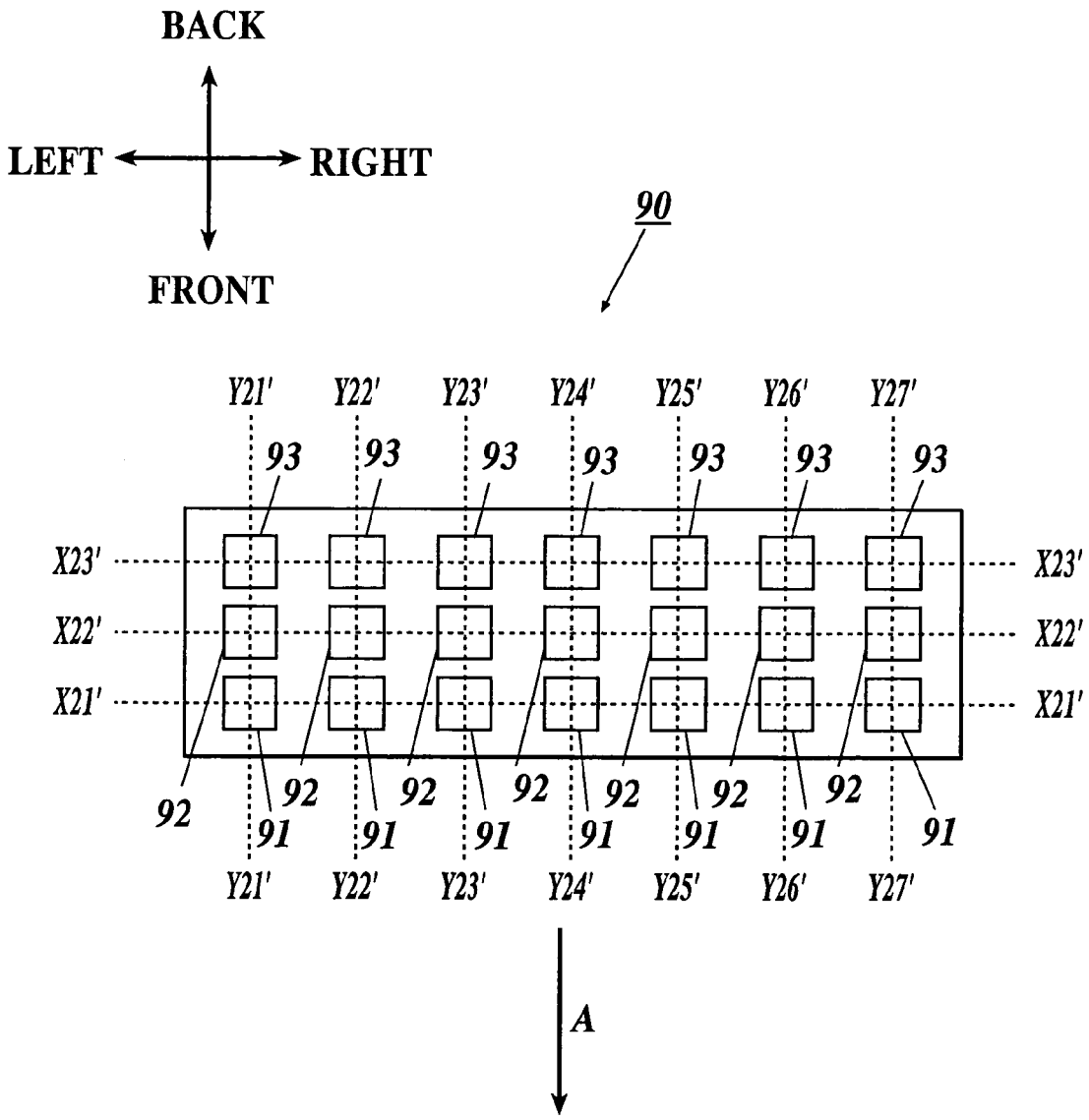
FIG. 11 is a plan view showing a illumination intensity detector according to the third embodiment.

FIG. 11 is a plan view showing the illumination intensity detector 90.

The illumination intensity detector 90 is provided with a plurality of sensors 91, 91, . . . , 92, 92, . . . , 93, 93, . . . . The sensors 91 are arranged along a row X21' shown by a dotted line "X21'" in FIG. 11 at equal intervals. Similarly, the sensors 92 are arranged along a row X22' shown by a dotted line "X22'" in FIG. 11 at equal intervals, and the sensors 93 are arranged along a row X23' shown by a dotted line "X23'" in FIG. 11 at equal intervals. Each of the rows X21' to X23' shown in FIG. 11 is along the carrying direction A of the recording medium.

Also, the plurality of sensors 91, 91, . . . , 92, 92, . . . , 93, 93, . . . of the illumination intensity detector 90 are arranged along lines Y21' to Y27' shown by dotted lines "Y21' to Y27'" in FIG. 11. The lines "Y21' to Y27'" shown in FIG. 11 are along the carrying direction A of the recording medium, and the sensors 91, 92, and 93 in each of the lines "Y21' to Y27'" are along the carrying direction A of the recording medium.

In such configuration, the rows X21 to X23 in FIG. 10A face the rows X21' to X23' in FIG. 11, respectively. Also, the lines Y21 to Y27 in FIG. 10A face the lines Y21' to Y27' in FIG. 11, respectively.

In the circuit configuration shown in FIG. 4, the recording heads 81-84 are connected to the control unit 61, so that the control unit 61 controls the operations of the recording heads 81-84. Each of the electric discharge tubes 87-89 of the light irradiating device 85 is connected to the control unit 61 through the individual drive circuit (driver), and the control unit 61 is adapted to control the power supply for each of the electric discharge tubes 87-89. That is, the control unit 61 can supply a different power supply to each of the electric discharge tubes 87-89.

Further, each of the sensors 91, 92, and 93 of the illumination intensity detector 90 is connected to the control unit 61 through the individual drive circuit (driver). The control unit 61 controls each of the sensors 91, 92, and 93 to detect the illumination intensity of the electric discharge tubes 87-89, and produces a two-dimensional illumination intensity distribution of the light of the light irradiating device 85 based on the detected result.

The carrying speed of the carrying mechanism 22 (relative moving speed to the light irradiating device 85) is applied as the condition to determine the recording mode instead of the scanning speed of the carriage 6. In this case, the "speed controlled mode" is a recording mode in which the carrying speed of the recording medium is slower than that in the normal mode. The speed controlled mode is for making the time duration of the light to which the ink is subjected long by making the carrying speed slower than that in the normal mode when the energy of the photo irradiation is insufficient for curing the ink placed on the recording medium.

In the recording mode display process shown in FIG. 5, each of the electric discharge tubes 87-89 lights up with the power supply in the normal mode in the processes in the Steps S2 to S4, detecting the illumination intensities of the light of the light irradiating device 85 with each of the sensors 91, 92, and 93 of the illumination intensity detector 90, and produces the two-dimensional illumination intensity distribution of the light of the light irradiating device 85 and the illumination profile of each of the rows X21 to X23, based on the detected results.

In the processes in the Steps S6 and S8, the judgments are made whether all illumination intensities in the illumination intensity profile of each of the rows X21 to X23 are not less than the first specified illumination intensity or the second specified illumination intensity.

In the process in the Step S11, the control unit 61 specifies the electric discharge tube causing to be below the second illumination intensity and an illumination intensity decreased portion thereof, and displays all or a part of the following (31) to (37) items expressed by using characters, symbols, images or the like as the warning window.

(31) Produced two-dimensional illumination intensity distribution

(32) Typically expressed two-dimensional illumination intensity distribution which was produced

(33) Illumination intensity profile of each of the rows X21 to X23

(34) Irradiation conditions of the light of the light irradiating device 85 (characters such as "good", "bad" or "partly bad", or symbols expressing them)

(35) Information indicating that being below the first illumination intensity and/or being below the second illumination intensity occur(s) in the light irradiating device 85

(36) Portion which is specified that being below the first illumination intensity and/or being below the second illumination intensity occur(s) in the light irradiating device 85

(37) The electric discharge tube which is specified that being below the first illumination intensity and/or being below the second illumination intensity occurs In the image recording operation, the recording medium is moved by the carrying mechanism 22 as a moving section relative to the light irradiating device 85 to be carried along the carrying direction A of the recording medium. In this state, the ink is discharged from each of the recording heads 81-84 onto the recording medium, and each of the electric discharge tubes 87-89 of the light irradiating device 85 lights up, so that the ink placed on the recording medium is irradiated with the light.

When the control unit 61 selects and executes the speed controlled mode, the recording medium is carried at the carrying speed slower than that in the power controlled mode, enabling to extend the duration time of the light to which the ink is subjected more than normal. On the other hand, when the control unit 61 selects and executes the power controlled mode, each of the electric discharge tubes 87-89 of the light irradiating device 85 is supplied with the power supply more than that in the normal mode or the power controlled mode, enabling to make the illumination intensity of the light to which the ink is subjected larger than normal.

In the third embodiment, similar to the first embodiment, when there is an illumination intensity which is less than the first specified illumination intensity in the illumination intensity profiles produced by the control unit 61, the second selection window is displayed on the display panel 21, and an image is recorded in substantially one of the recording modes of the speed controlled mode and the power controlled mode by a users' selection and input operations. Thus, while recording an image, the ink is irradiated with the light having the energy of photo irradiation enough to properly cure the ink, which is successful in properly curing the ink and obtaining an image of good quality.

The present invention is not limited to the third embodiment, and various improvements and design changes may be made without departing from the spirit of the present invention as follows.

As one of the improvements and design changes, when the control unit 61 selects and executes the power controlled mode, only the electric discharge tube causing to be below the first illumination intensity may be supplied with the power supply in the power controlled mode.

Figure 12:
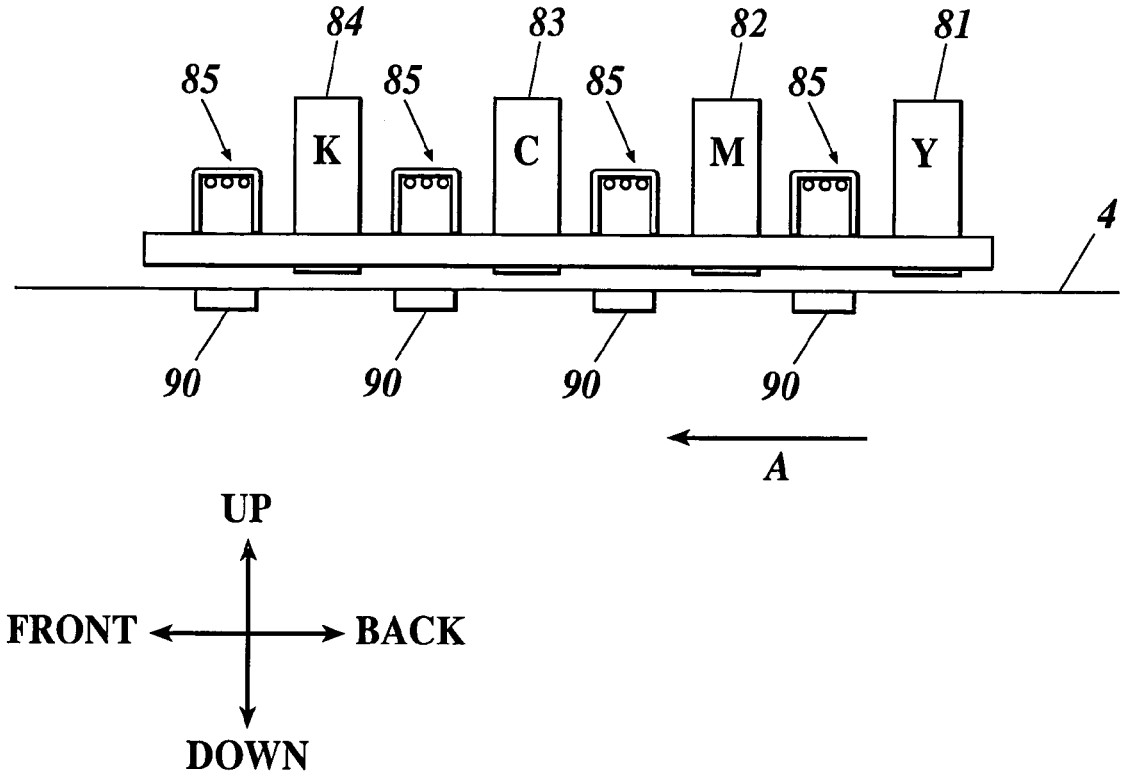
FIG. 12 is a side view showing a modified example of the recording member in FIGS. 10A and 10B.

As one of the improvements and design changes, as shown in FIG. 12, the light irradiating device 85 and the illumination intensity detector 90 may be arranged on the downstream side of each of the recording heads 81-84 (only one of the electric discharge tubes 87-89 may be arranged on each light irradiating device 85).

In this case, in the recording mode display process shown in FIG. 5, in the processes in the Steps S2 to S4, each of the electric discharge tubes 87-89 lights up with the power supply in the normal mode, the illumination intensities are detected for each light irradiating device 85 by the sensors 91, 92, and 93 of the illumination intensity detector 90, and the two-dimensional illumination intensity distribution of the light of each light irradiating device 85 and the illumination profiles of each of the rows X21 to X23 are produces, based on the detected results.

In the processes in the Steps S6 and S8, the judgments are made whether all illumination intensities in the illumination intensity profiles are not less than the first specified illumination intensity or the second specified illumination intensity, for each light irradiating device 85, and it is judged whether being below the first illumination intensity or being below the second illumination intensity occurs in each light irradiating device 85.

In the process in the Step S11, the control unit 61 specifies the light irradiating device causing to be below the second illumination intensity and the electric discharge tube in the light irradiating device, and displays all or a part of the following (41) to (47) items expressed by using characters, symbols, images or the like as the warning window.

(41) Produced two-dimensional illumination intensity distribution

(42) Typically expressed two-dimensional illumination intensity distribution which was produced

(43) Illumination intensity profile of each of the rows X21 to X23

(44) Irradiation conditions of the light of each light irradiating device 85 (characters such as "good", "bad" or "partly bad", or symbols expressing them)

(45) Information indicating that being below the first illumination intensity and/or being below the second illumination intensity occur(s) in at least one of the light irradiating devices 85

(46) Portion which is specified that being below the first illumination intensity and/or being below the second illumination intensity occur(s) in at least one of the light irradiating devices 85

(47) The light irradiating device which is specified that being below the first illumination intensity and/or being below the second illumination intensity occur(s)

(48) The electric discharge tube which is specified that being below the first illumination intensity and/or being below the second illumination intensity occur(s)

In the image recording operation, when the control unit 61 selects and executes the power controlled mode, the electric discharge tubes 87-89 of each light irradiating device 85 are supplied with the same power supply in the power controlled mode. In this case, the power supply may be supplied only to the light irradiating device 85 or the electric discharge tubes 87-89 causing to be below the first illumination intensity.

Further, the present invention is not limited to the above first to third embodiments, and various improvements and design changes may be made without departing from the spirit of the present invention as follows.

As one of the changes of improvements and designs, in the process of producing the two-dimensional illumination intensity distribution, the number of the lines Y1 to Y3, the lines Y1' to Y3', the lines Y11 to Y13, the lines Y11' to Y13', the lines Y21 to Y27, and the lines Y21' to Y27' are appropriately set according to, or not according to the type of the light irradiating device 11, 12, 16, or 85 (type or the number of the light source or the like) or the type of the illumination intensity detector 30 or 90 (type or the number of the sensor or the like). Similarly to the above, the number of the rows X1 to X7, the rows X1' to X7', the rows X11 to X17, the rows X11' to X17', the rows X21 to X23, and the rows X21' to X23' are appropriately set.

As another changes of improvements and designs, a cold cathode bactericidal lamp, a hot cathode bactericidal lamp, a low-pressure mercury vapor lamp, a high-pressure mercury vapor lamp, an electrodeless lamp, an excimer lamp, a metal halide lamp, a xenon lamp, or the like may be applied instead of the LED 13, 14, or 15 or the electric discharge tube 17, or 89-89.

The entire disclosure of Japanese Patent Applications No. Tokugan 2004-25011 and 2004-291302 which were filed on Feb. 2, 2004, and Oct. 4, 2004, respectively, including specification, claims, drawings and summary are incorporated herein by reference in its entirety.

What is claimed is:

1. An image recording apparatus, comprising:

a recording head which discharges a photo curable ink which is cured by photo irradiation;

a light irradiating device which irradiates the photo irradiation to the photo curable ink on a recording medium and includes a plurality of light sources;

a detector which detects an illumination intensity of each of the light sources;

a first judgment section which judges whether the illumination intensity of each of the light sources is less than a first illumination intensity based on a result of detection by the detector or not; and a controller which controls an energy of the photo irradiation for the photo curable ink in accordance with a detected illumination intensity which is less than the first illumination intensity, when the first judgment section judges one of the light sources having an illumination intensity which is less than the first illumination intensity exists, wherein the image recording apparatus has three image recording modes, which are a normal recording mode where an image recording operation is executed by moving the recording medium and/or the light irradiating device relatively in a predetermined speed and by supplying a power supply for the light irradiating device at a predetermined power, a speed controlled mode where the image recording operation is executed in a speed lower than the predetermined speed, and a power controlled mode where the image recording operation is executed in a power higher than the predetermined power, and wherein the controller executes the image recording operation based on either the normal recording mode, the speed controlled mode, or the power controlled mode, and wherein the controller selects the power controlled mode and executes the recording operation based on the power controlled mode, when the first judgment section judges one of light sources having the illumination intensity which is less than the first illumination intensity exists, after that, when the first judgment section judges one of light sources having the illumination intensity which is less than the first illumination intensity exists again, the controller selects the speed controlled mode and executes the recording operation based on the speed controlled mode.

2. The image recording apparatus of claim 1, wherein, in the speed controlled mode, the controller controls the energy of the photo irradiation for the photo curable ink by controlling a time duration of light with which the photo curable ink is irradiated.

3. The image recording apparatus of claim 2, further comprising:

a moving section which moves the recording medium and/or the light irradiating device relatively, wherein, in the speed controlled mode, the controller selects a speed of a relative movement by the moving section that is lower than in the normal recording mode.

4. The image recording apparatus of claim 3, wherein the controller controls the time duration by decreasing a moving speed of the light irradiating device.

5. The image recording apparatus of claim 3, wherein the controller controls the time duration by decreasing a moving speed of the recording medium.

6. The image recording apparatus of claim 1, wherein, in the power controlled mode, the controller controls the energy of the photo irradiation for the photo curable ink by controlling the illumination intensity of light with which the photo curable ink is irradiated.

7. The image recording apparatus of claim 6, wherein, in the power controlled mode, the controller makes a power supply for the light irradiating device larger than in the normal recording mode.

8. The image recording apparatus of claim 1, further comprising:

a second judgment section which judges whether each illumination intensity of the light sources is not less than a second illumination intensity lower than the first illumination intensity based on the result of detection by the detector or not; and a warning section which generates an alert to a user, when the second judgment section judges one of light sources having an illumination intensity which is less than the second illumination intensity exists.

9. The image recording apparatus of claim 1, further comprising:

a second judgment section which judges whether each illumination intensity of the light sources is not less than a second illumination intensity lower than the first illumination intensity based on the result of detection by the detector or not, wherein the controller prohibits an image recording operation of the image recording apparatus, when the second judgment section judges one of light sources having an illumination intensity which is less than the second illumination intensity exists.

10. The image recording apparatus of claim 1, wherein the light sources are provided in a direction perpendicular to a direction that the recording medium is relatively moved.

11. The image recording apparatus of claim 1, wherein the controller automatically selects the power controlled mode and executes the recording operation based on the power controlled mode, when the first judgment section judges one of light sources having the illumination intensity which is less than the first illumination intensity exists.

12. The image recording apparatus of claim 1, wherein the controller automatically selects the speed controlled mode and executes the recording operation based on the speed controlled mode, when the first judgment section judges one of light sources having the illumination intensity which is in than the first illumination intensity exists again.

13. The image recording apparatus of claim 1, further comprising:

a display section which displays a selection window for selecting an operation mode, wherein the controller selects the power controlled mode or the speed controlled mode in accordance with a selection at the selection section.

14. The image recording apparatus of claim 1, wherein the apparatus is connected to a computer, and the controller selects the power controlled mode or the speed controlled mode In accordance with an instruction via the computer.

* * * * *